United States Patent [19]

Nakazyo et al.

[11] Patent Number: 4,956,268

[45] Date of Patent: Sep. 11, 1990

[54] BLEACH-FIXING SOLUTION CONCENTRATE COMPOSITION AND METHOD FOR PROCESSING SILVER HALIDE COLOR PHOTOGRAPHIC MATERIALS

[75] Inventors: Kiyoshi Nakazyo; Takatoshi Ishikawa; Yoshikazu Fujita, all of Kanagawa, Japan

[73] Assignee: Fuji Photo Film Co., Ltd., Kanagawa, Japan

[21] Appl. No.: 343,323

[22] Filed: Apr. 26, 1989

[30] Foreign Application Priority Data

Apr. 28, 1988 [JP] Japan ..... 63-105683

[51] Int. Cl.[5] ..... G03C 7/00; G03C 7/02; G03C 5/38

[52] U.S. Cl. ..... 430/393; 430/450; 430/458; 430/460; 430/461

[58] Field of Search ..... 430/393, 450, 458, 460, 430/461; 252/93, 104, 546; 134/3

[56] References Cited

U.S. PATENT DOCUMENTS

| | | | |
|---|---|---|---|
| 3,751,251 | 8/1973 | Surash | 430/460 |
| 4,141,734 | 2/1979 | Lenoir et al. | 430/445 |
| 4,294,914 | 10/1981 | Fyson | 430/460 |
| 4,366,232 | 12/1982 | Buser et al. | 430/460 |
| 4,828,970 | 5/1989 | Kuse et al. | 430/393 |

FOREIGN PATENT DOCUMENTS

| | | |
|---|---|---|
| 0293729 | 12/1988 | European Pat. Off. . |
| 1386384 | 3/1975 | United Kingdom . |

OTHER PUBLICATIONS

Research Disclosure 10150, "Method for Preparing Bleach-Fix Regeneration Concentrate," 9/72.

Patent Abstracts of Japan, vol. 5, No. 110, Jul. 17, 1981, p. 81 P 71 (JP-A-56 52 748).

European Search Report.

*Primary Examiner*—Paul R. Michl

*Assistant Examiner*—Patrick A. Doody

*Attorney, Agent, or Firm*—Sughrue, Mion, Zinn, Macpeak & Seas

[57] ABSTRACT

A two-part bleach-fixing solution composition comprising of a first concentrate composition containing a reducing compound comprising a silver halide solvent and a preservative as main components; and a second concentrate composition having a pH of 1.5 or less, containing an oxidizing compound comprising a bleaching agent and an acid as main components.

The invention also relates to a method for processing a silver halide color photographic material by the steps of:

(a) developing an exposed silver halide color photographic material comprising a support having thereon at least one red-sensitive silver halide emulsion layer containing at least one coupler represented by formula (I) or (II); at least one green-sensitive silver halide emulsion layer containing at least one coupler represented by formula (III) or (IV); and at least one blue-sensitive silver halide emulsion layer containing a yellow coupler represented by formula (V):

(I)

(II)

(III)

(IV)

(V)

wherein $R_1$, $R_2$ and $R_4$ each represents an aliphatic group, an aromatic group, a heterocyclic group, an aromatic amino group or a heterocyclic amino group; $R_5$ represents an aliphatic group; $R_3$ and $R_6$ each represents hydrogen, a halogen atom, an aliphatic group, an aliphatic oxy group or an acylamino group; $R_7$ and $R_9$ each represents a substituted or unsubstituted phenyl group; $R_8$ represents hydrogen, an aliphatic acyl group, an aromatic acyl group, an aliphatic sulfonyl group or an aromatic sulfonyl group; $R_{10}$ represents hydrogen or a substituent; Q represents a substituted or unsubstituted N-phenylcarbamoyl group; Za and Zb each represents unsubstituted methine, substituted methine or =N—; $Y_1$, $Y_2$ and $Y_4$ each represents a halogen atom or a coupling releasable group; $Y_3$ represents hydrogen or a coupling releasable group; and $Y_5$ represents a coupling releasable group; and (b) bleach-fixing said developed silver halide color photographic material using a bleach-fixing solution prepared by diluting and combining the two-part bleach-fixing solution of the invention.

14 Claims, No Drawings

BLEACH-FIXING SOLUTION CONCENTRATE COMPOSITION AND METHOD FOR PROCESSING SILVER HALIDE COLOR PHOTOGRAPHIC MATERIALS

FIELD OF THE INVENTION

The present invention concerns bleach-fixing (blixing) solution concentrate compositions for silver halide color photographic materials and a method for processing these materials and, more precisely, it concerns stable and inexpensive blixing solution concentrate compositions and a method for processing silver halide color photographic materials with improved processing stability in which these blixing concentrate compositions are used.

BACKGROUND OF THE INVENTION

In general, blixing solution concentrate compositions for use with silver halide color photographic materials are desired to facilitate handling, to be convenient, to reduce transportation costs and to reduce packaging costs, and the processing solutions are provided as concentrates which are diluted with water for use when required.

These blixing solution concentrate compositions are divided into a number of parts, thus separating the components to enable concentration to be achieved while maintaining stability.

Conventionally, blixing solution concentrate compositions for color printing purposes have been provided in two parts, which is to say, a part (Part (A)) of pH 6 to 8 containing a reducing compound comprising a silver halide solvent and a preservative as the main components, and a part (Part (B)) of pH 4 to 6 containing an oxidizing compound of which a bleaching agent is the main component. In practice, the designated quantities of the two parts are mixed together for use and the pH is adjusted, as required, and the pH of the solution which is used is generally in the range from 6 to 7. However, more recently, use has been made of solutions which have a lower pH of from 4 to 6 in use in order to shorten the desilvering time to speed up processing. Consequently, it has been necessary to provide a further part (Part (C)) which contains an acid for adjusting the pH as the main component. Hence, the concentrate has been provided in three parts, but this has proved to be inconvenient in respect of ease of handling, convenience, transportation costs and low packaging material costs.

Part (C) must be packed separately because the sulfite which is normally used as a preservative becomes unstable and decomposes if the pH of Part (A) is reduced, while if the pH of Part (B) is reduced then the EDTA Fe(III), the bleaching agent normally used, may be reduced to form an Fe(II) with a loss of oxidizing ability. The EDTA chelating agent may precipitate out, and it becomes difficult to provide a uniform composition. Hence, Part (C) in which the acid for pH adjustment is isolated, must be provided separately and in practice the composition must be provided in three parts.

SUMMARY OF THE INVENTION

One object of the present invention is to provide a blixing solution concentrate composition in two parts which has excellent stability and which is inexpensive, and convenient in respect of handling.

A further object of the present invention is to provide a method of processing silver halide color photographic materials, in which the blixing solution concentrate composition is used, in which the processing is rapid, and in which processing stability is improved.

It has now been found that these and other objects of the present invention are attained by:

a two-part bleach-fixing solution composition composed of a first concentrate composition containing a reducing compound comprising a silver halide solvent and a preservative as main components; and a second concentrate composition having a pH of 1.5 or less, containing an oxidizing compound comprising a bleaching agent and an acid as main components.

A method for processing a silver halide color photographic material by the steps of:

(a) developing an exposed silver halide color photographic material comprising a support having thereon at least one red-sensitive silver halide emulsion layer containing at least one coupler represented by formula (I) or (II); at least one green-sensitive silver halide emulsion layer containing at least one coupler represented by formula (III) or (IV); and at least one blue-sensitive silver halide emulsion layer containing a coupler represented by formula (V):

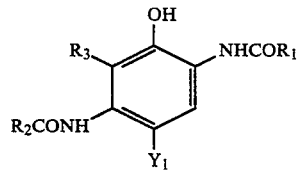

(I)

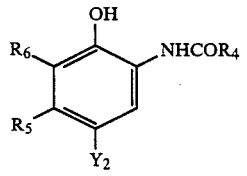

(II)

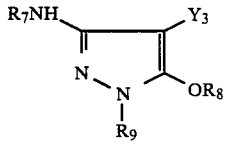

(III)

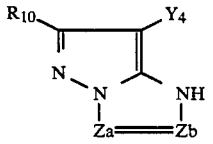

(IV)

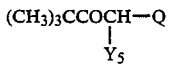

(V)

wherein $R_1$, $R_2$ and $R_4$ each represents an aliphatic group, an aromatic group, a heterocyclic group, an aromatic amino group or a heterocyclic amino group; $R_5$ represents an aliphatic group; $R_3$ and $R_6$ each represents hydrogen, a halogen atom, an aliphatic group, an aliphatic oxy group or an acylamino group; $R_7$ and $R_9$ each represents a substituted or unsubstituted phenyl group; $R_8$ represents hydrogen, an aliphatic acyl group, an aromatic acyl group, an aliphatic sulfonyl group or an aromatic sulfonyl group; $R_{10}$ represents hydrogen or a substituent; Q represents a substituted or unsubstituted N-phenylcarbamoyl group; Za and Zb each represents unsubstituted methine, substituted methine or =N—; $Y_1$, $Y_2$ and $Y_4$ each represents a halogen atom or a coupling releasable group; $Y_3$ represents hydrogen or a coupling releasable group; and $Y_5$ represents a coupling releasable group; and further, in formulae (I) and (II), $R_2$ and $R_3$, and $R_5$ and $R_6$, may be joined together to form a 5-, 6- or 7-membered ring, furthermore, polymers consisting of two or more monomers may be formed via $R_1$, $R_2$, $R_3$ or $Y_1$; $R_4$, $R_5$, $R_6$ or $Y_2$; $R_7$, $R_8$, $R_9$ or $Y_3$; $R_{10}$, Za, Zb or $Y_4$; or Q or $Y_5$, and the aliphatic groups described above preferably represent a straight chain, a branched chain or cyclic alkyl, alkenyl or alkynyl groups, and (b) bleach-fixing said developed silver halide color photographic material using a bleach-fixing solution prepared by diluting and combining a first concentrate composition containing a reducing compound comprising a silver halide solvent and a preservative as main components; and a second concentrate composition having a pH of 1.5 or less, containing an oxidizing compound comprising a bleaching agent and an acid as main components.

DETAILED DESCRIPTION OF THE INVENTION

Blixing solution concentrate compositions for silver halide color photographic materials are concentrated with a view to reducing transportation costs, ease of handling and reducing the cost of packaging materials, and they are divided into two or three parts in view of the stability of the concentrate composition. For use, designated quantities of the liquids which have been provided as two or three parts are diluted with water to provide a blixing (bleach-fixing) solution for silver halide color photographic materials.

The blixing solution concentrate compositions for silver halide color photographic materials of the present invention are provided in two parts, one part (i.e., first concentrate composition) (referred to hereinafter as Part A) which preferably comprises a silver halide solvent, chelating agent and preservative as the main components, and another part (i.e., second concentrate composition) (referred to hereinafter as Part B) which preferably comprises a bleaching agent such as particularly a ferric aminopolycarboxylic acid complex salt, a halide, chelating agent and an acid as the main components, and the concentration factor of each solution is generally from 3 to 20 times, and preferably from 4 to 10 times. A high concentration factor is undesirable in terms of dissolution and in respect of the occurrence of crystallization from the solution under low temperature conditions. On the other hand, a low concentration factor reduces the handling convenience and removes some of the cost advantage.

The term "the concentration factor" means "the ratio of the amount of concentrate to the amount of the diluted concentrate to be used".

The pH of Part A concentrate composition is preferably within the range of from 5 to 9 and more preferably within the range of from 6 to 8.

Thiosulfates, thiocyanates, thioether compounds, thioureas, thioglycolic acid and large amounts of iodides can be used, for example, as silver halide solvent components in Part A, but thiosulfates are normally used, and ammonium thiosulfate, in particular, is used in the widest range of applications. These compounds can be used individually or as mixtures of two or more compounds.

The concentrate concentration of these silver halide solvents is generally from 5 to 10 mol/liter (i.e., from 5 to 10 mol per liter of the composition of Part A), and preferably from 2 to 5 mol/liter.

Sulfites, bisulfites, metabisulfites, ascorbic acid, carbonyl-bisulfite adduct or the sulfinic acid compounds disclosed in Japanese Patent Application No. 62-280810 are generally used as preservatives, and the use of the sulfites, bisulfites and metabisulfites is especially desirable. The concentrate concentration of these preservatives is generally from 1 to 6 mol/liter of the composition of Part A, and preferably from 1.2 to 3.0 mol/liter.

Chelating agents, for example, are preferably included as other components of Part A. Aminopolycarboxylic acids are generally used as chelating agents, and examples of such compounds are indicated below, but the present invention is not to be construed as being limited thereto.

1. Ethylenediaminetetraacetic acid
2. Diethylenetriaminepentaacetic acid
3. Cyclohexanediaminetetraacetic acid
4. 1,2-Propylenediaminetetraacetic acid
5. Ethylenediamine-N-(β-oxyethylene)-N,N',N'-triacetic acid
6. 1,3-Diaminopropanetetraacetic acid
7. 1,4-Diaminobutanetetraacetic acid
8. Glycol ether diaminetetraacetic acid
9. Iminodiacetic acid
10. N-Methyliminodiacetic acid
11. Ethylenediaminetetrapropionic acid
12. N-(2-Acetamido)iminodiacetic acid
13. Dihydroxyethylglycine
14. Ethylenediaminedi-o-hydroxyphenylacetic acid Among these, compounds of Nos. 1, 2, 3 and 6 are preferred.

These may be added in the free form or in the form of alkali metal salts or ammonium salts, and the amount added to the concentrate composition is generally from $0.4\times10^{-2}$ to $2.7\times10^{-2}$ mol/liter of the composition of Part A, and preferably from $0.5\times10^{-2}$ to $1.4\times10^{-2}$ mol/liter.

The use of a ferric complex salt of an organic acid is preferred for the bleaching agent in Part B, and the use of ferric complex salts of aminopolycarboxylic acid is especially desirable. Examples of these aminopolycarboxylic acids are indicated below, but the present invention is not to be construed as being limited thereto.

1. Ethylenediaminetetraacetic acid
2. Diethylenetriaminepentaacetic acid
3. Cyclohexanediaminetetraacetic acid
4. 1,2-Propylenediaminetetraacetic acid
5. Ethylenediamine-N-(β-oxyethylene)-N,N',N'-triacetic acid
6. 1,3-Diaminopropanetetraacetic acid
7. 1,4-Diaminobutanetetraacetic acid
8. Glycol ether diaminetetraacetic acid
9. Iminodiacetic acid
10. N-Methyliminodiacetic acid
11. Ethylenediaminetetrapropionic acid
12. N-(2-Acetamido)iminodiacetic acid
13. Dihydroxyethylglycine
14. Ethylenediaminedi-o-hydroxyphenylacetic acid Compounds 1, 2, 3 and 6 are preferred among these compounds.

The ferric complex salts of the aminopolycarboxylic acids may be used in the form of a complex salt, or the complex salt of the ferric ion may be formed in the solution using an aminopolycarboxylic acid together with a ferric salt, such as ferric sulfate, ferric chloride, ferric nitrate, ferric ammonium sulfate or ferric phosphate, for example. When a complex salt is used, it is possible to use one type of complex salt or a mixture of two or more types of complex salt. On the other hand, when the complex salt is formed in the solution using a ferric salt and an aminopolycarboxylic acid, it may be formed using one or more than one type of ferric salt. Moreover, it can also be formed using one or more than one type of aminopolycarboxylic acid. Furthermore, in either case, the aminopolycarboxylic acid is used in excess with respect to the amount required to form the ferric ion complex salt.

Furthermore, complex salts of metal ions such as cobalt and copper, for example, instead of iron can be introduced into the bleach-fixing (blixing) solutions which contain the above-mentioned ferric iron complex salts.

The concentrate concentration of these bleaching agents is generally from 0.2 to 2.8 mol/liter of the composition of Part B, and preferably from 0.3 to 1.4 mol/-liter.

Mineral acids such as hydrochloric acid, nitric acid, sulfuric acid and phosphoric acid, and organic acids such as citric acid, tartaric acid and acetic acid, can normally be used for the acid component, and these acids can be used in admixture with one or more salt of these acids in order to provide a buffering effect. The use of hydrochloric acid, nitric acid and acetic acid is preferred. The pH of Part B concentrate composition is within the range of from 0 to 1.5 and preferably within the range of from 0.1 to 0.5.

Furthermore, if desired, halides (halogenated agents) and chelating agents are preferably used in Part B, and bromides, such as potassium bromide, sodium bromide or ammonium bromide, or chlorides, such as potassium chloride, sodium chloride or ammonium chloride, can be added as the halides. Among these halides, preferred halides are potassium bromide, sodium bromide and ammonium bromide, and more preferred halide is ammonium bromide. Various chelating agents such as those described earlier in connection with Part A can be used as chelating agents.

Moreover, bleaching accelerators, brightening agents, defoaming agents, surfactants, fungicides, anticorrosion agents and organic solvents, such as polyvinylpyrrolidone or methanol, for example, can be added to the Part A and Part B concentrate compositions, if desired.

Furthermore, normally used containers made of polyethylene, polypropylene, polystyrene, polyvinyl, vinyl chloride or glass, for example, can be used for housing these blixing solution concentrate compositions, but the use of containers made from materials which have a low oxygen permeability as disclosed in European Pat. No. 0250219, JP-A-Nos. 63-17453 and 63-125143 (the term "JP-A" as used herein refers to a "published unexamined Japanese patent application") is preferred from the point of view of the stability of the blixing solution concentrate compositions. The preferred storage temperature is generally from 0° to 10° C.

The blixing solution concentrate composition is diluted in accordance with the concentration factor prior to use, and when in use the pH of the solution may generally be within the range from 3 to 8. The preferred pH range is from 4 to 6. Furthermore, processing can be generally carried out at temperatures within the range from 30° C. to 50° C., but a temperature within the range from 30° C. to 40° C. is preferred. The processing time is generally within 5 minutes, and a time within the range from 10 seconds to 3 minutes 30 seconds is preferred. Moreover, in practice the use of a replenisher is required, and it is preferred that an amount of the replenisher used is small. Thus, the amount of replenisher is generally from 20 to 600 ml, and preferably from 50 to 200 ml, per square meter of photosensitive material processed.

The blixing solution concentrate compositions for silver halide color photographic materials of the present invention can be used in conjunction with color developing solution concentrate compositions (referred to hereinafter as CD concentrate compositions) or with after-mixed color developers. Normally, processing solutions separately prepared using a blixing solution concentrate composition and a CD concentrate composition are used. The CD concentrate composition is, like the blixing solution concentrate compositions of the present invention, concentrated with a view to reducing transportation costs, increasing convenience in handling and reducing packaging material costs, and it is divided into three or four parts in view of the stability of the concentrate composition. In use, specified amounts of the three or four parts are diluted with water in accordance with the concentration factors and supplied for use as a developing solution for silver halide color photographic materials.

The CD concentrate composition usually contains three or four parts such as three parts of developing agents/alkali agents/preservatives, alkali agents and brightening agents; or four parts of developing agents/alkali agents/preservatives, brightening agents/benzyl alcohol, benzyl alcohol solvents and alkali agents. The concentration factors are generally adjusted to within the range from 10 to 30 times. The concentration factors are selected in accordance with the solubilities of the added reagents and their low temperature crystallization properties.

The developing agents are typified by the p-phenylenediamine derivatives. Some examples are indicated below, but the present invention is not to be construed as being limited thereto.

D- 1 N,N-Diethyl-p-phenylenediamine
D- 2 2-Amino-5-diethylaminotoluene
D- 3 2-Amino-5-(N-ethyl-N-laurylamino)toluene
D- 4 4-[N-Ethyl-N-(β-hydroxyethyl)amino]aniline
D- 5 4-Methyl-4-[N-ethyl-N-(β-hydroxyethyl-)amino]aniline
D- 6 4-Amino-3-methyl-N-ethyl-N-[β-(methanesulfonamido)ethyl]aniline
D- 7 N-(2-Amino-5-diethylaminophenylethyl)methanesulfonamide
D- 8 N,N-Dimethyl-p-phenylenediamine
D- 9 4-Amino-3-methyl-N-ethyl-N-methoxyethylaniline
D-10 4-Amino-3-methyl-N-ethyl-N-β-ethoxyethylaniline
D-11 4-Amino-3-methyl-N-ethyl-N-β-butoxyethylaniline The use of 4-amino-3-methyl-N-ethyl-N-[β-(methanesulfonamido)ethyl]aniline (illustrative Compound D-6) among the above-mentioned p-phenylenediamine derivatives is especially desirable.

These p-phenylenediamine derivatives may also be used in the form of salts, such as their sulfates, hydrochlorides, sulfites or p-toluenesulfonates, for example.

The pH of the part in which the developing agent forms the principal component is generally within the range from 0.1 to 4 and preferably within the range from 0.2 to 3.0. The alkali agent is a buffer for raising the pH of the developing solution and this constitutes one of the parts. The color developing solutions generally used have a pH of from 9 to 12 and preferably of from 9.11. Various buffers are used to maintain this pH. The use of carbonates, phosphates, tetraborates and hydroxybenzoates, for example, for the buffer is preferred. These buffers have the advantage of excellent solubility and buffering ability in the high pH range of 9 or more, they have no adverse effect on photographic performance and they are inexpensive.

As well as sulfites, bisulfites and metabisulfites, amine compounds such as hydroxylamines, hydroxamic acids, hydrazines, hydrazides, monoamines, diamines, tertiary amines and polyamines, sugars, alkanolamines, polyethyleneimines and aromatic polyhydroxy compounds, for example, may be added, either singly or in combinations, if desired, as preservatives.

The 4,4'-diamino-2,2'-disulfostilbene-based compounds are generally used as brightening agents.

Alkanolamines and/or glycols are generally used with a view to providing highly concentrated solutions of benzyl alcohol in the case of processing formulations in which benzyl alcohol is used. Examples of these materials include triethanolamine and diethylene glycol.

Furthermore, chelating agents such as aminopolycarboxylic acids and organic phosphonic acids; surfactants such as alkylsulfonic acids, aliphatic carboxylic acids, aromatic carboxylic acids and arylsulfonic acids; developing accelerators such as thioether compounds, p-phenylenediamine-based compounds, quaternary ammonium salts, amine-based compounds, poly(alkylene oxide) compounds, 1-phenyl-3-pyrazolidones and imidazoles; antifogging agents such as alkali metal halides, triazoles, imidazoles, isoindazoles, thiadiazoles, oxadiazoles and hydroxyazaindolizines, can be added, if desired.

The processing temperature in the color developing solution is generally from 20° C. to 50° C. and preferably from 30° C. to 40° C., and the processing time is generally from 20 seconds to 5 minutes and preferably from 30 seconds to 4 minutes. It is preferred that the amount of the replenisher used is small, and the amount of replenisher is generally from 20 to 600 ml and preferably of from 50 to 300 ml per square meter of photo-sensitive material.

The silver halide color photographic materials used in the present invention are usually washed with water and/or subjected to a stabilization treatment after desilvering with blixing.

The amount of water used in the water washing process can be fixed within a wide range according to the nature of the photosensitive material (for example, the materials, such as couplers, which are being used), and its intended application, the washing water temperature, the number of washing tanks (the number of washing stages), the replenishment system (i.e., whether a countercurrent or a cocurrent system is used), and various other conditions. The relationship between the amount of water used and the number of water washing tanks in a multistage countercurrent system can be obtained using the method outlined on pages 248 to 253 of *Journal of the Society of Motion Picture and Television Engineers,* Vol. 64 (May, 1955). The number of stages in a normal multistage countercurrent system is preferably from 2 to 6 and more preferably from 2 to 4.

The amount of washing water can be greatly reduced by using a multistage countercurrent system and, for example, it is possible to use the amount of from 0.5 to 1 liter per square meter of photosensitive material and the effect of the present invention is pronounced. However, bacteria proliferate due to the increased residence time of the water in the tanks and problems arise as a result of the suspended matter which are formed becoming attached to the photosensitive material. The method in which the calcium and manganese concentrations are reduced as disclosed in JP-A-62-288838 can be used very effectively to overcome problems of this sort in the processing of color photosensitive materials of the present invention. Furthermore, the isothiazolone compounds and thiabendazoles disclosed in JP-A-57-8542, chlorine-based disinfectants such as chlorinated sodium isocyanurate disclosed in JP-A-61-120145, the benzotriazoles disclosed in JP-A-61-267761, copper ions, and the disinfectants disclosed in *Chemistry of Biocides and Fungicides* by Horiguchi, *Killing Microorganisms, Biocidal and Fungicidal Techniques,* published by the Health and Hygiene Technical Society, and in *A Dictionary of Biocides and Fungicides,* published by the Japanese Biocide and Fungicide Society, can be used for this purpose.

Moreover, surfactants as wetting agents, and chelating agents typified by EDTA as water softening agents can be used in the water washing water.

The photosensitive materials can also be treated with a stabilizing solution after the water washing process as described above, or directly without the use of a water washing process. Compounds which have an image stabilizing function can be added to the stabilizing solution, and examples of such compounds include aldehydes typified by formalin, buffers for adjusting to a film pH which is suitable for dye stabilization, and ammonia compounds. Furthermore, the various types of biocides and fungicides aforementioned can be used to prevent the proliferation of bacteria in the bath and to provide the processed photosensitive material with fungicidal properties. Moreover, surfactants, brightening agents and film hardening agents can also be added.

Any of the known methods disclosed, for example, in JP-A-Nos. 57-8543, 58-14834 and 60-220345 can be used in cases where, when processing photosensitive materials of the present invention, the materials are stabilized directly without a water washing process.

The use of chelating agents, such as 1-hydroxyethylidene-1,1-diphosphonic acid and ethylenediaminetetramethylenephosphonic acid, and magnesium or bismuth compounds, is also desirable.

Rinsing solutions can also be used in the same way as the water washing solutions or stabilizing solutions which are used after desilvering in the present invention.

The pH in the water washing or stabilization process in the present invention is generally between 4 and 10 and preferably between 5 and 8. The temperature can be set variously, depending on the application and characteristics of the photosensitive material, but it is generally from 15° C. to 45° C. and preferably from 20° C. to 40° C. The time can be set without particular limitation, and a short time is preferred. Thus, a washing/stabilization time of from 30 seconds to 3 minutes is preferred, and a time of from 15 seconds to 2 minutes is especially desirable. A low amount of the replenisher is preferred from the point of view of running costs, effluent disposal and handling.

Actual preferred amount of replenisher is generally from 0.5 to 50 times and preferably from 3 to 40 times the carry over from the previous bath per unit area of photosensitive material. Alternatively, the amount of replenisher is generally not more than 1 liter and preferably not more than 500 ml per square meter of photosensitive material. Furthermore, replenishment can be carried out continuously or intermittently.

The liquid used in the water washing and/or stabilization processes can also be used in the earlier steps. For example, the overflow of water washing water recovered using a multistage countercurrent system can be introduced into the preceding bleach-fixing bath and a concentrated solution can be used to replenish the bleach-fixing bath with a reduction in the amount of effluent.

The method of the present invention can be applied to any process provided that a color developing solution is used. For example, it can be applied to the processing of color papers, color reversal papers, color direct positive photosensitive materials, color positive films, color negative films, and color reversal films.

The couplers which can be used in each of the red-, green- and blue-sensitive layers of a silver halide color photographic material in the present invention are described in detail below.

In cases where $Y_1$, $Y_2$, $Y_3$, $Y_4$ and $Y_5$ in formulae (I), (II), (III), (IV) and (V) represent coupling releasable groups (referred to hereinafter as "releasable groups"), the releasable groups are, for example, aliphatic groups, aromatic groups, heterocyclic groups; aliphatic, aromatic or heterocyclic sulfonyl groups; aliphatic, aromatic or heterocyclic carbonyl groups; each bonded to the coupling active carbon via an oxygen, nitrogen, sulfur or carbon atom; nitrogen-containing heterocyclic groups which are bonded via a nitrogen atom to the coupling position; halogen atoms or aromatic azo groups. The aliphatic, aromatic or heterocyclic groups which are contained in these coupling releasable groups may be substituted with the substituents for $R_1$ (described hereinafter). In cases where there are two or more of these substituents, they may be the same or different, and these substituents may also have further substituents for $R_1$.

Examples of coupling releasable groups include halogen atoms (for example, fluorine, chlorine, bromine), alkoxy groups (for example, ethoxy, dodecyloxy, methoxyethylcarbamoylmethoxy, 3-(methanesulfonamido)propyloxy, carboxypropyloxy, methylsulfonylethoxy), aryloxy groups (for example, 4-chlorophenoxy, 4-methoxyphenoxy, 3-sulfonamidophenoxy, 4-(N,N'-diethylsulfamoyl)phenoxy, 4-carboxyphenoxy), acyloxy groups (for example, acetoxy, tetradecanoyloxy, benzoyloxy), aliphatic or aromatic sulfonyloxy groups (for example, methanesulfonyloxy, toluenesulfonyloxy), acylamino groups (for example, dichloroacetylamino, heptafluorobutyrylamido), aliphatic or aromatic sulfonamido groups (for example, methanesulfonamido, p-toluenesulfonylamino), alkoxycarbonyloxy groups (for example, ethoxycarbonyloxy, benzyloxycarbonyloxy), aryloxycarbonyloxy groups (for example, phenoxycarbonyloxy), aliphatic, aromatic or heterocyclic thio groups (for example, ethylthio, phenylthio, tetrazolylthio), carbamoylamino groups (for example, N-methylcarbamoylamino, N-phenylcarbamoylamino), 5- or 6-membered nitrogen-containing heterocyclic groups (for example, indazolyl, pyrazolyl, triazolyl, tetrazolyl, 1,2-dihydro-2-oxo-1-pyridyl), imido groups (for example, succinimido, hydantoinyl) and aromatic azo groups (for example, phenylazo), and these groups may be substituted with the substituents for $R_1$. Furthermore, the present invention includes bis type couplers obtained by condensing 4-equivalent couplers with aldehydes or ketones in which the coupling releasable group is bonded via a carbon atom. The coupling releasable groups of the present invention may contain photographically useful groups such as developing inhibitors or developing accelerators. The preferred coupling releasable group combinations in each formula are described hereinafter.

$R_1$, $R_2$ and $R_4$ in formulae (I) and (II), which may be the same or different, each preferably represents an aliphatic group which preferably has from 1 to 36 carbon atoms, an aromatic group which preferably has from 6 to 36 carbon atoms (for example, phenyl, naphthyl), a heterocyclic group (for example, 3-pyridyl, 2-furyl), or an aromatic or heterocyclic amino group (for example, anilino, naphthylamino, 2-benzothiazolylamino, 2-pyridylamino), and these groups may be further substituted with groups selected from alkyl groups, aryl groups, heterocyclic groups, alkoxy groups (for example, methoxy, 2-methoxyethoxy), aryloxy groups (for example, 2,4-di-tert-amylphenoxy, 2-chlorophenoxy, 4-cyanophenoxy), alkenyloxy groups (for example, 2-propenyloxy), acyl groups (for example, acetyl, benzoyl), ester groups (for example, butoxycarbonyl, phenoxycarbonyl, acetoxy, benzoyloxy, butoxysulfonyl, toluenesulfonyloxy), amido groups (for example, acetylamino, ethylcarbamoyl, dimethylcarbamoyl, methanesulfonamide, N,N-dibutylsulfamoyl, 3-(2,4-di-tert-amylphenoxy)propylsulfamoyl, benzenesulfonamide, 2-butoxy-5-tert-octylbenzenesulfonamide, dodecanesulfonamide, butylsulfamoyl), sulfamide groups (for example, dipropylsulfamoylamino), imide groups (for example, succinimide, hydantoinyl), ureido groups (for example, phenylureido, dimethylureido), aliphatic or aromatic sulfonyl groups (for example, methanesulfonyl, phenylsulfonyl, 2-butoxy-5-tert-octylphenylsulfonyl), aliphatic or aromatic thio groups (for example, ethylthio, phenylthio), hydroxy groups, cyano groups, carboxyl groups, nitro groups, sulfo groups and halogen atoms.

The above substituents for $R_1$ also represent "the substituents (permitted) for $R_1$", which are referred hereinbefore and hereinafter.

In this specification, the term "aliphatic group" signifies a straight chain, branched chain or cyclic aliphatic hydrocarbon group, and this may be saturated or unsaturated being, for example, an alkyl group, an alkenyl group or an alkynyl group. Typical examples include methyl, ethyl, butyl, dodecyl, octadecyl, icosenyl, isopropyl, tert-butyl, tert-octyl, tert-dodecyl, cyclohexyl, cyclopentyl, allyl, vinyl, 2-hexadecenyl and propargyl groups.

$R_5$ in formula (II) preferably represents an aliphatic group which has from 1 to 20 carbon atoms, and this may be substituted with the substituents permitted for $R_1$.

$R_3$ and $R_6$ in formulae (I) and (II) each represents hydrogen, a halogen atom (for example, fluorine, chlorine, bromine), an aliphatic group which preferably has from 1 to 20 carbon atoms, an aliphatic oxy group which preferably has from 1 to 20 carbon atoms, or an acylamino group which preferably has from 1 to 20 carbon atoms (for example, acetamide, benzamide, tetradecanamide), and these aliphatic groups, aliphatic oxy groups and acylamino groups may be substituted with the substituents permitted for $R_1$.

$R_2$ and $R_3$ in formula (I) can be joined to form a 5- to 7-membered ring.

$R_5$ and $R_6$ in formula (II) can be joined to form a 5- to 7-membered ring.

Polymer couplers consisting of dimers or larger units may be formed individually or conjointly via any of $R_1$, $R_2$, $R_3$ or $Y_1$ in formula (I), and any of $R_4$, $R_5$, $R_6$ and $Y_2$ in formula (II). In the case of a dimer, these groups may be single bonds, or divalent linking groups (for example, alkylene groups, arylene groups, ether groups, ester groups or amide groups, or combinations of these divalent groups), and in the case of oligomers and polymers, those in which these groups form the main polymer chain and those in which the coupler units are linked to a main polymer chain via divalent groups such as those described in connection with dimeric forms are preferred. When a polymer is formed, it may be a coupler derived homopolymer or a copolymer with one or more non-color-forming ethylenic monomers (for example, acrylic acid, methacrylic acid, methyl acrylate, n-butylacrylamide, β-hydroxyethyl ethyl methacrylate, vinyl acetate, acrylonitrile, styrene, crotonic acid, maleic anhydride or N-vinylpyrrolidone).

Substituted or unsubstituted alkyl or aryl groups are preferred for $R_2$ in formula (I) and $R_4$ in formula (II). Phenoxy groups which may be substituted and halogen atoms are especially preferred as substituents for the alkyl groups (the phenoxy groups may be further substituted with alkyl groups, alkoxy groups, halogen atoms, sulfonamide groups, sulfamoyl groups and carboxyl groups), and phenyl groups substituted with at least one halogen atom, alkyl group, sulfonamide group, sulfamoyl group, carboxyl group or acylamino group are especially preferred as aryl groups.

The preferred groups for $R_1$ in formula (I) are substituted alkyl groups, or substituted or unsubstituted aryl groups, and halogen atoms are especially preferred as substituents for the alkyl groups, and phenyl groups or phenyl groups which are substituted with at least one halogen atom, sulfonamide group or sulfamoyl group are especially preferred as substituents for the aryl groups.

Alkyl groups which have from 1 to 20 carbon atoms and which may be substituted are preferred for $R_5$ in formula (II). Alkyloxy or aryloxy groups, acylamino groups, alkylthio or arylthio groups, imide groups, ureido groups and alkylsulfonyl or arylsulfonyl groups are preferred as substituents for $R_5$.

$R_6$ in formula (II) is preferably a halogen atom (more preferably fluorine or chlorine), or an acylamino group, and it is more preferably a halogen atom.

$R_3$ in formula (I) is preferably hydrogen, an alkyl group which has from 1 to 20 carbon atoms or an alkenyl group, and it is more preferably hydrogen.

$R_2$ and $R_3$ in formula (I) preferably form a 5-or 6-membered nitrogen-containing heterocyclic ring.

$R_5$ in formula (II) is more preferably an alkyl group which has from 2 to 4 carbon atoms.

$Y_1$ and $Y_2$ in formulae (I) and (II) are preferably halogen atoms, and more preferably chlorine atoms.

The couplers represented by formulae (I) and (II) can be used individually or in the form of a mixture of couplers, but the use of couplers of formula (I) or mixtures of couplers of formula (I) and formula (II) is preferred.

It is well known in the industry that magenta couplers represented by formula (III) in which $R_8$ is hydrogen exhibit keto-enol type tautomerism as indicated below. Hence, the structure shown on the left in the present invention includes the alternate form shown on the right.

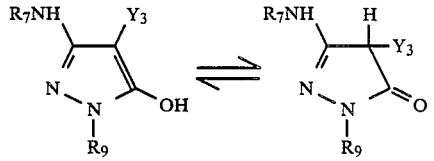

The substituent groups for $R_9$ and $R_7$ in formula (III) are the same as the substituents for the aromatic groups in $R_1$, and when there are two or more substituents these may be the same or different groups.

$R_8$ in formula (III) is preferably hydrogen, aliphatic acyl group or aliphatic sulfonyl group, and more preferably it is hydrogen. $Y_3$ is preferably a group of the type which is eliminated with sulfur, oxygen or nitrogen, and sulfur releasing groups are especially preferable.

In formula (IV), $R_{10}$ preferably represents hydrogen; halogen atoms; cyano groups; aliphatic groups, aromatic groups and heterocyclic groups as defined for $R_1$ above, $R'_1O$—, above, $R'_1O$—, $R'_1C(=O)$—, $R'_1CO(=O)$—, $R'_1SO$—, $R'_1SO_2$—, $R'_1SO_2NH$—, $R'_1C(=O)NH$—, $R'_1NH$—, $R'_1S$—, $R'_1$—NH—C(=O)—NH—, $(R'_1)_2N$—C(=O)—NH—, $R'_1OC(=O)NH$—, silyl groups, silyloxy groups, silylamino groups or imino groups ($R'_1$ means aliphatic groups, aromatic groups and heterocyclic groups).

The compounds represented by formula (IV) are 5-membered-5-membered condensed nitrogen-containing heterocyclic couplers (referred to hereinafter as 5,5-N-heterocyclic couplers). The color-forming parent nucleus has an aromaticity which is isoelectronic with naphthalene and normally they have a chemical structure which is generally known as an azapentalene structure. The preferred couplers represented by formula (IV) are the 1H-imidazo[1,2-b]pyrazoles, the 1H-pyrazolo[5,1-c]-[1,2,4]triazoles, the 1H-pyrazolo[1,5-b][1,2,4]triazoles and the 1H-pyrazolo[1,5-d]tetrazoles, and these are represented by formulae (IV-1), (IV-2), (IV-3) and (IV-4).

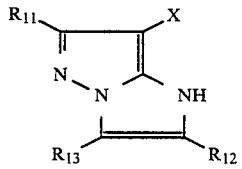

(IV-1)

-continued

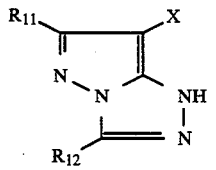

(IV-2)

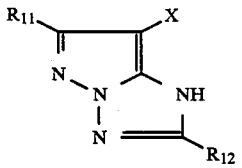

(IV-3)

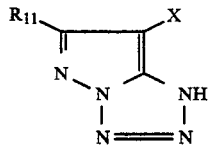

(IV-4)

The substituents in formula (IV-1) to (IV-4) are described in detail below. $R_{11}$, $R_{12}$ and $R_{13}$, which may be the same or different, each represents hydrogen, halogen atoms, cyano groups, aliphatic groups, aromatic groups and heterocyclic groups as defined for $R_1$ above, $R'_1O-$, $R'_1\underset{\underset{O}{\|}}{C}-$, $R'_1\underset{\underset{O}{\|}}{C}O-$, $R'_1SO-$, $R'_1SO_2-$, $R'_1SO_2NH-$, $R'_1\underset{\underset{O}{\|}}{C}NH-$, $R'_1NH-$, $R'_1S-$, $R'_1NH-\underset{\underset{O}{\|}}{C}-NH-$, $(R'_1)_2N-\underset{\underset{O}{\|}}{C}-NH-$, $R'_1O\underset{\underset{O}{\|}}{C}NH-$ $R'_1$ means an aliphatic group, an aromatic group and a heterocyclic group), silyl groups, silyloxy groups, silylamino groups or imino groups. $R_{11}R_{12}$ and $R_{13}$ may be carbamoyl groups, sulfamoyl groups or sulfamoylamino groups, and the nitrogen atoms of these groups may be substituted with the substituents for $R_1$. X has the same definition as $Y_4$. Furthermore, these may form dimers with a divalent group for $R_{11}$, $R_{12}$, $R_{13}$ or X, or these groups may be groups which link the coupler parent nucleus to a polymer chain.

$R_{11}$, $R_{12}$ and $R_{13}$ are preferably hydrogen, halogen atoms, aliphatic groups, aromatic groups or heterocyclic groups as defined for $R_1$ in formula (I), $R_1O-$, $R_1CONH-$, $R_1SO_2NH-$, $R_1NH-$, $R_1S-$, $R_1NHCONH-$, $(R_1)_2N-CONH-$ or $R_1OCONH-$ groups. X is preferably a halogen atom, an acylamino group, an imino group, an aliphatic or aromatic sulfonamide group, a 5- or 6-membered nitrogen-containing heterocyclic group which is bonded via a nitrogen atom to the coupling position, an aryloxy group, an alkoxy group, an arylthio group or an alkylthio group.

The substituents for the phenyl group of the N-phenylcarbamoyl group Q in formula (V) can be selected from among the substituents for $R_1$ when $R_1$ is an aromatic group, and when there are two or more substituents they may be the same or different.

Q is preferably a group represented by formula (VA) which is shown below.

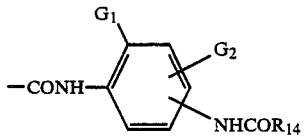

(VA)

wherein $G_1$ represents a halogen atom or an alkoxy group, and $G_2$ represents hydrogen, a halogen atom or an alkoxy group which may have substituents. $R_{14}$ represents an alkyl group which may have substituents.

Typical substituents for $G_2$ and $R_{14}$ in formula (VA) include alkyl groups, alkoxy groups, aryl groups, aryloxy groups, amino groups, dialkylamino groups, heterocyclic groups (for example, N-morpholino, N-piperidino, 2-furyl), halogen atoms, nitro groups, hydroxyl groups, carboxyl groups, sulfo groups, sulfonamide groups, sulfamoyl groups and alkoxycarbonyl groups.

The preferred coupling releasable groups for $Y_5$ include groups represented by formulae (X) to (XVI) indicated below.

$-\overset{|}{O}R_{20}$ (X)

wherein $R_{20}$ represents a heterocyclic group or an aryl group which may be substituted.

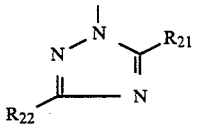

(XI)

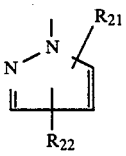

(XII)

wherein $R_{21}$ and $R_{22}$, which may be the same or different, each represents hydrogen, a halogen atom, a carboxylic acid ester group, an amino group, an alkyl group, an alkylthio group, an alkoxy group, an alkylsulfonyl group, an alkylsulfonamide group, an arylsulfonamide group, a sulfamoyl group, an alkylsulfinyl group, a carboxylic acid group, a sulfonic acid group, or a substituted or unsubstituted phenyl or heterocyclic group, and these groups may be the same or different.

(XIII)

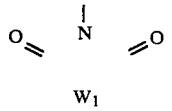

wherein $W_1$ represents a group of nonmetal atoms which is required to form, together with the parts of the formula represented by

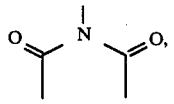

a 4-, 5- or 6-membered ring.

Compounds represented by formula (XIII) are preferably represented by formulae (XIV) to (XVI).

(XIV)

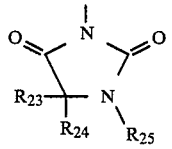

(XV)

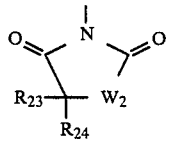

(XVI)

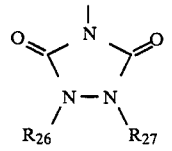

In these formulae, $R_{23}$ and $R_{24}$, which may be the same or different, each represents hydrogen, an alkyl group, an aryl group, an alkoxy group, a sulfonamide group, a sulfamoyl group, a carboxyl group, an aryloxy group or a hydroxyl group; $R_{25}$, $R_{26}$, $R_{27}$, which may be the same or different, each represents hydrogen, an alkyl group, an aryl group, an aralkyl group or an acyl group; and $W_2$ represents oxygen or sulfur.

Illustrative examples of other couplers represented by formulae (I) to (V) and methods for their preparation are well known.

Thus, the cyan couplers represented by formulae (I) and (II) can be prepared using known methods. For example, cyan couplers represented by formula (II) can be prepared using the methods disclosed, for example, in U.S. Pat. Nos. 2,423,730 and 3,772,002, and cyan couplers represented by formula (I) can be prepared using the methods disclosed, for example, in U.S. Pat. Nos. 2,895,826, 4,333,999 and 4,327,173.

Magenta couplers represented by formula (III) can be prepared using the methods disclosed, for example, in JP-A-No. 49-74027, JP-A-No. 49-74028, JP-B-No. 48-27930, JP-B-53-33846 and U.S. Pat. No. 3,519,429 (the term "JP-B" as used herein refers to an "examined Japanese patent publication"). Magenta couplers represented by formulae (IV-1), (IV-2), (IV-3) and (IV-4) can be prepared using the methods disclosed respectively, for example, in JP-A-No. 59-162548, U.S. Pat. No. 3,725,067, JP-A-No. 59-171956 and JP-A-No. 60-33552.

Yellow couplers represented by formula (V) can be prepared using the methods disclosed, for example, in JP-A-No. 54-48541, JP-B-No. 58-10739, U.S. Pat. No. 4,326,024 and in *Research Disclosure,* No. 18053.

The use of cyan coupler represented by formula (I) or the conjoint use of couplers represented by formulae (I) and (II) for the cyan coupler; a coupler represented by formula (III) or formula (IV) for the magenta coupler; and a coupler represented by formula (V) for the yellow coupler is preferred in the silver halide color photographic materials which are used in the present invention.

More preferably, combinations of couplers represented by formula (I) for the cyan couplers; couplers which have groups which can be released in a coupling reaction with the oxidation products of a developing agent other than hydrogen in the coupling position in formula (III) or couplers represented by formulae (IV-2) or (IV-3) for the magenta couplers; and couplers in which the group which can be released in a coupling reaction with the oxidation products of a developing agent are bonded via a nitrogen atom for the yellow coupler are used. The preferred combinations are selected for improving color-forming properties, colored image fastness and color reproduction characteristics.

Preferred examples of couplers represented by formulae (I) to (V) are indicated below, but the present invention is not to be construed as being limited thereto.

(C-1)

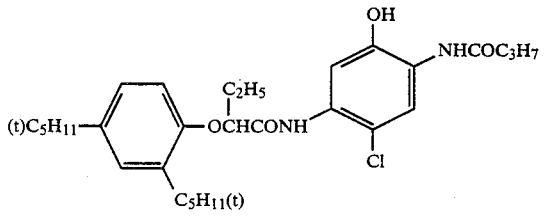

-continued
(C-2)
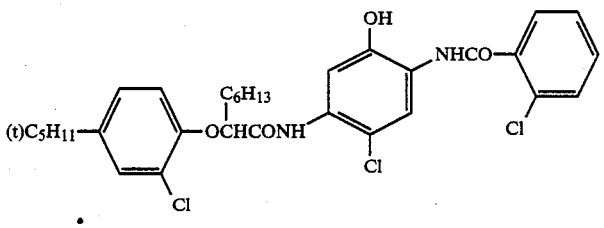
(C-3)
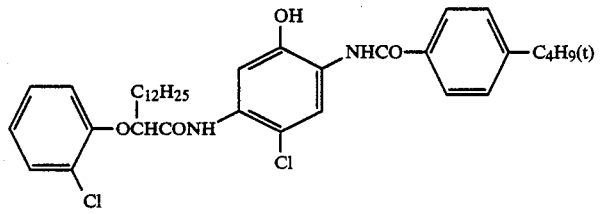
(C-4)
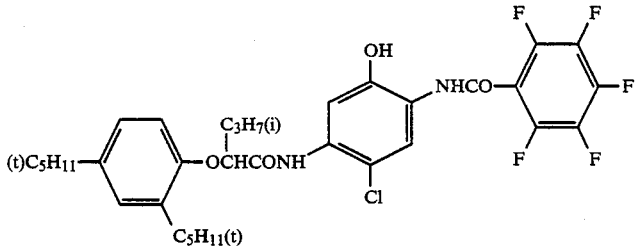
(C-5)
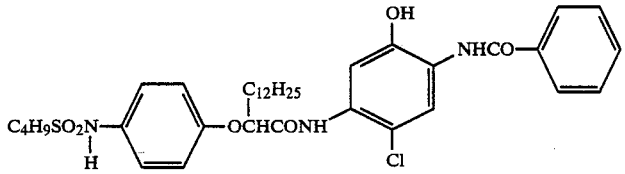
(C-6)
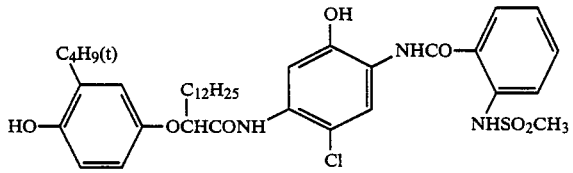
(C-7)
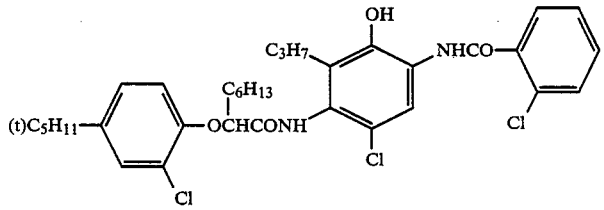
(C-8)
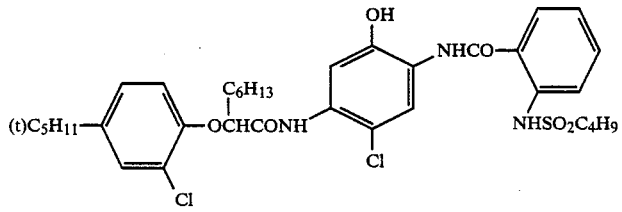

-continued
(C-9)
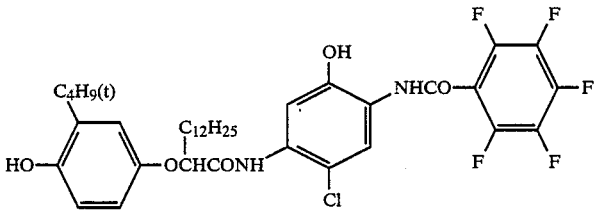
(C-10)
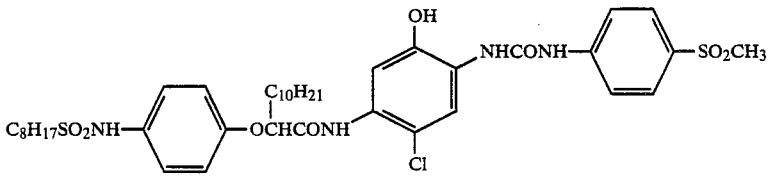
(C-11)
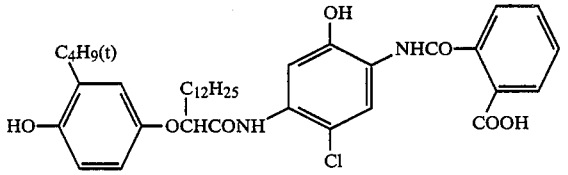
(C-12)
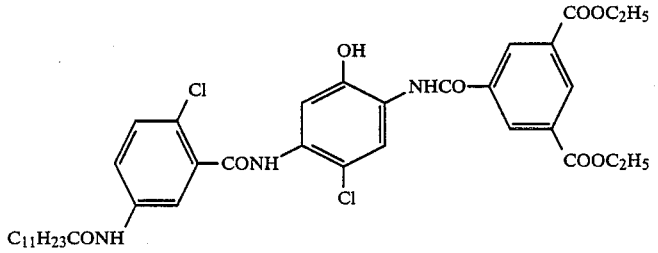
(C-13)
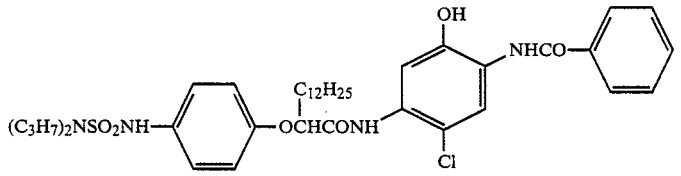
(C-14)
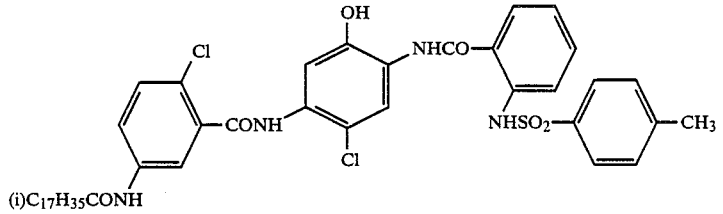
(C-15)
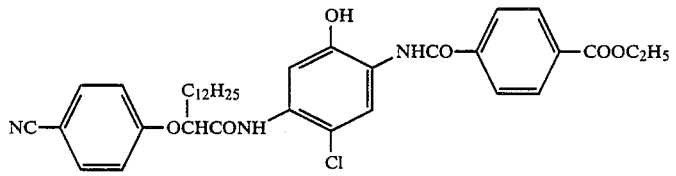

-continued
(C-16)
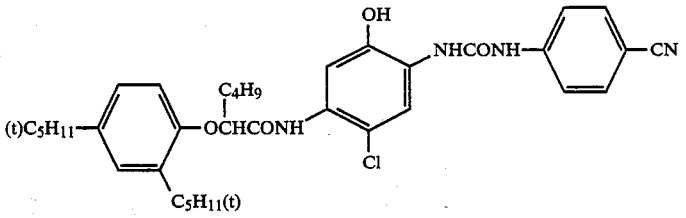
(C-17)
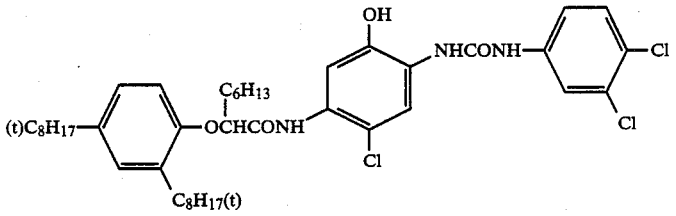
(C-18)
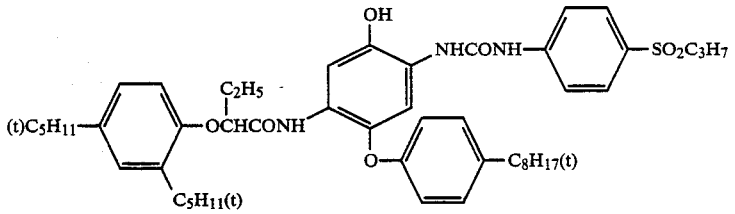
(C-19)
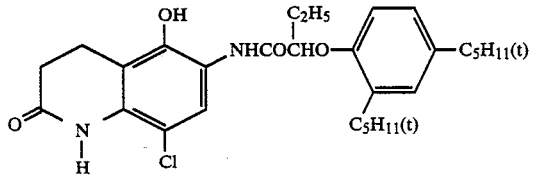
(C-20)
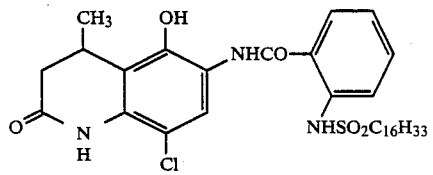
(C-21)
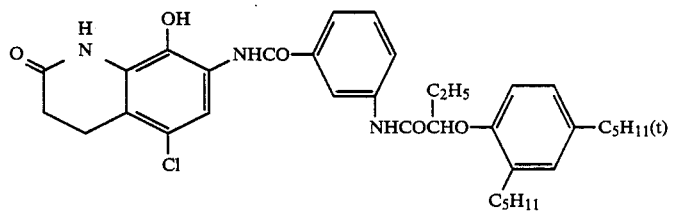
(C-22)
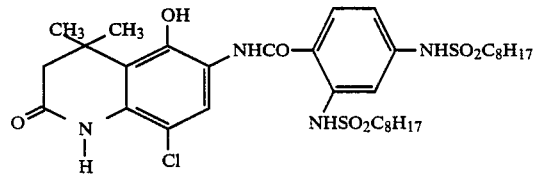

-continued
(C-23)
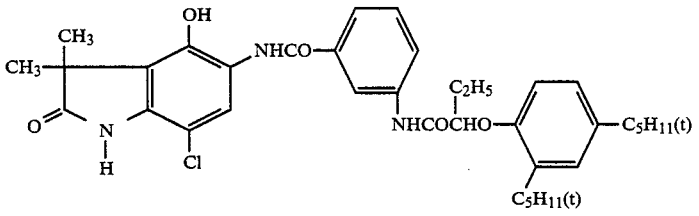
(C-24)
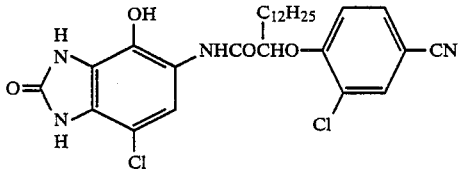
(C-25)
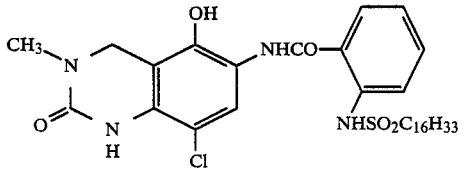
(C-26)
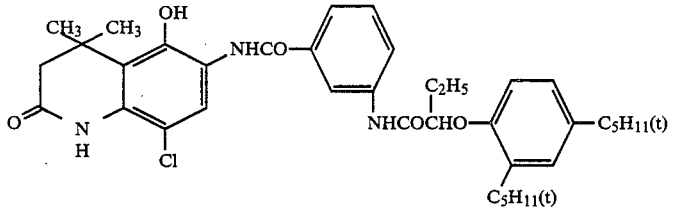
(C-27)
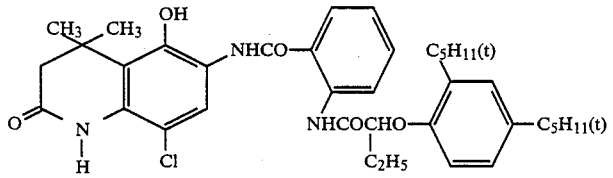
(C-28)
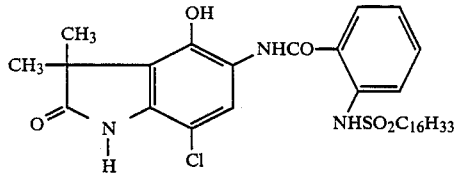
(C-29)
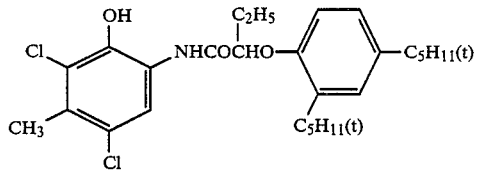
(C-30)
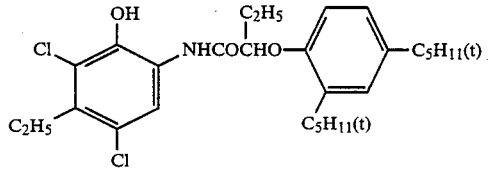

-continued
(C-31)
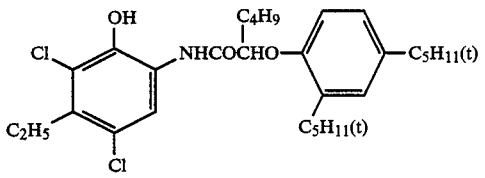
(C-32)
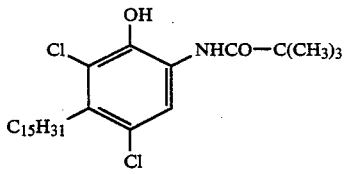
(C-33)
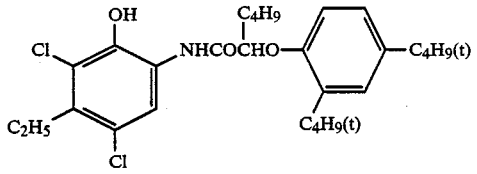
(C-34)
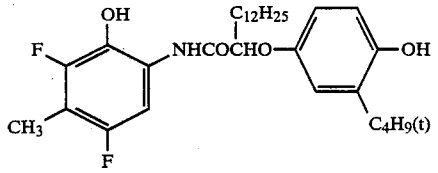
(C-35)
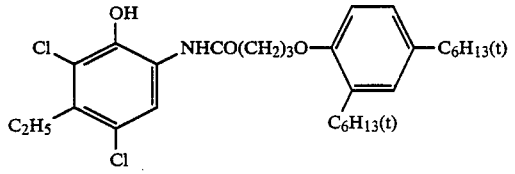
(C-36)
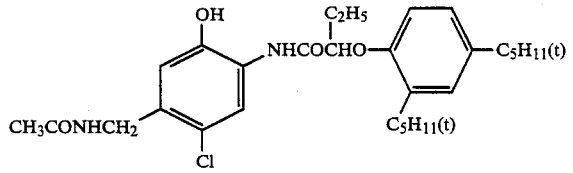
(C-37)
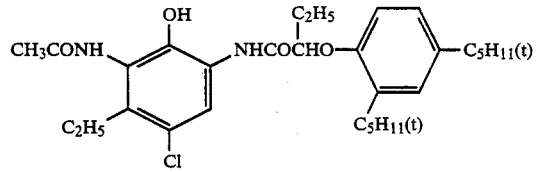
(C-38)
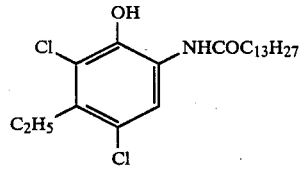
(C-39)
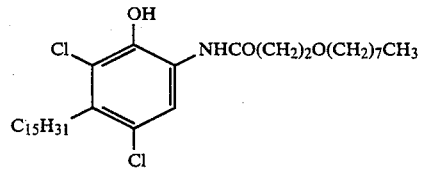

-continued
(C-40)
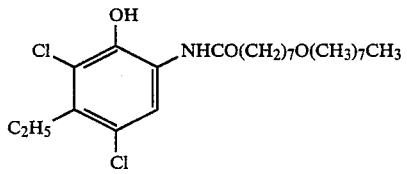
(C-41)
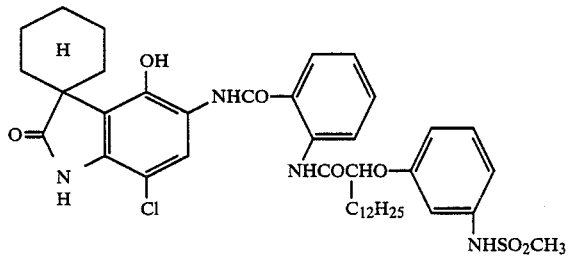
(C-42)
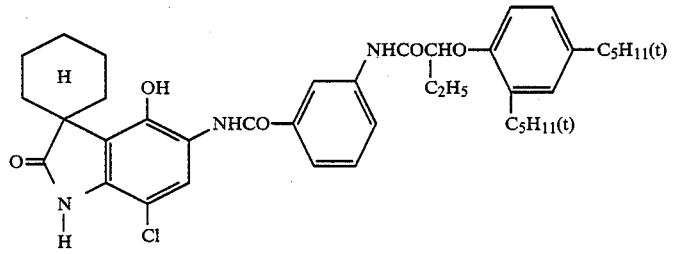
(C-43)
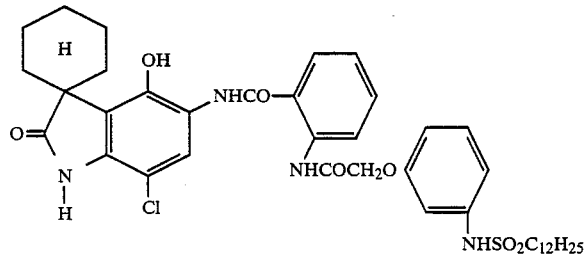
Preferred examples of couplers represented by formulae (III) and (IV) are shown below, but the present invention is not to be construed as being limited thereto.
(M-1)
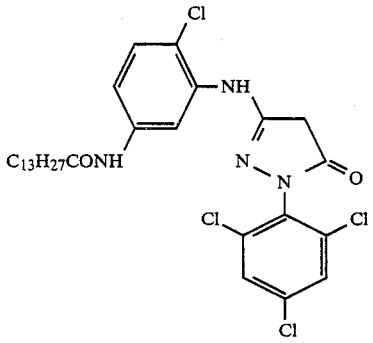

-continued
(M-2)
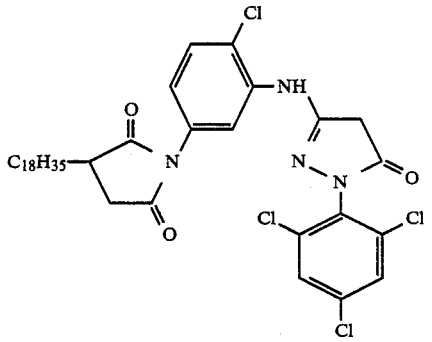
(M-3)
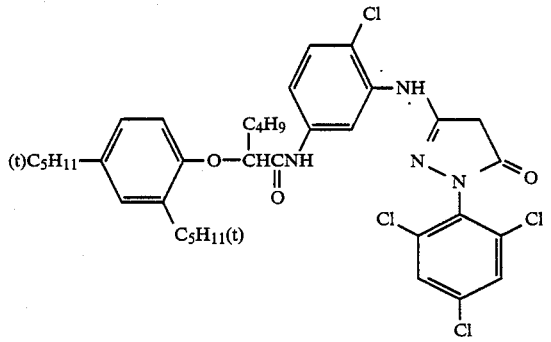
(M-4)
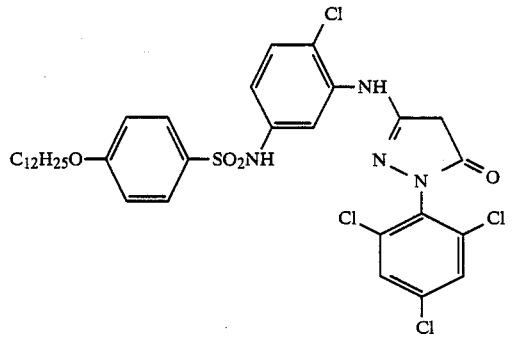
(M-5)
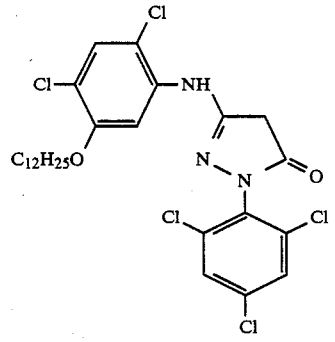

-continued
(M-6)
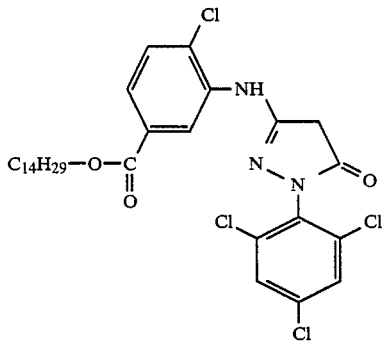
(M-7)
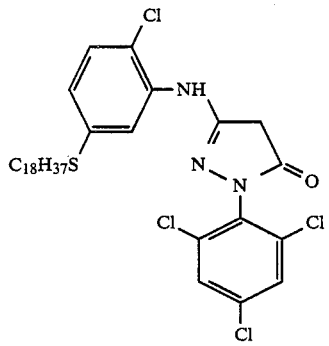
(M-8)
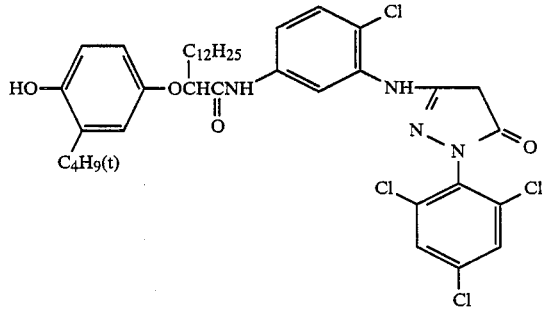
(M-9)
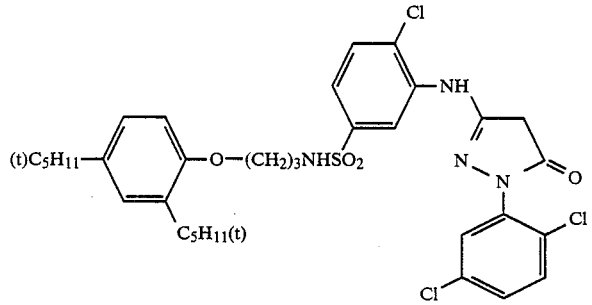
(M-10)
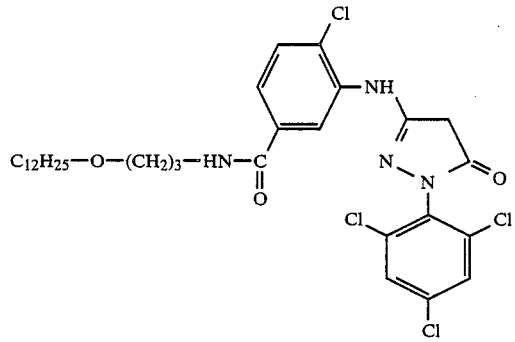

-continued
(M-11)
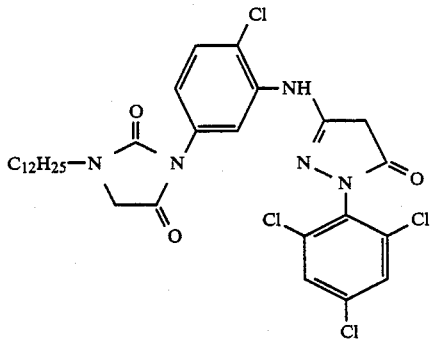
(M-12)
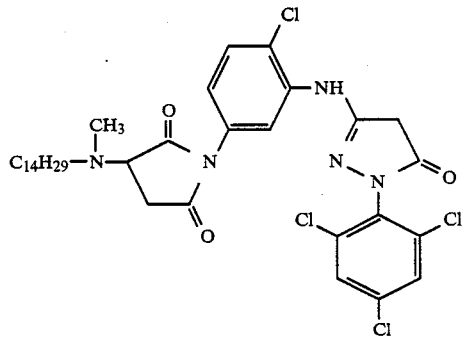
(M-13)
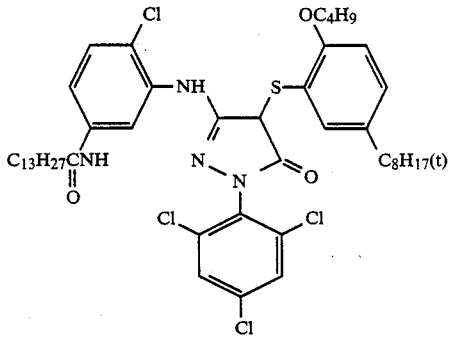
(M-14)
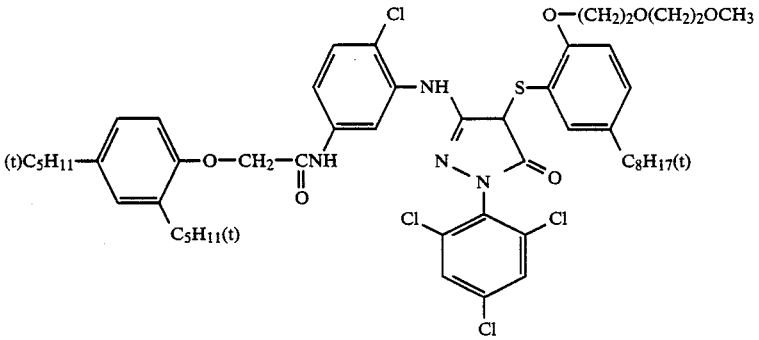

-continued
(M-15)
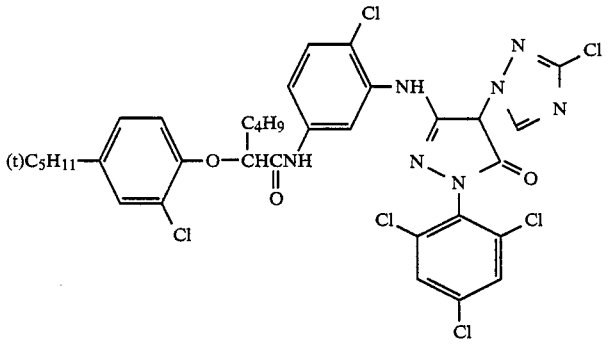
(M-16)
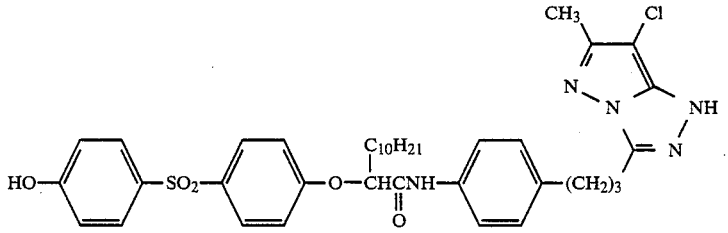
(M-17)
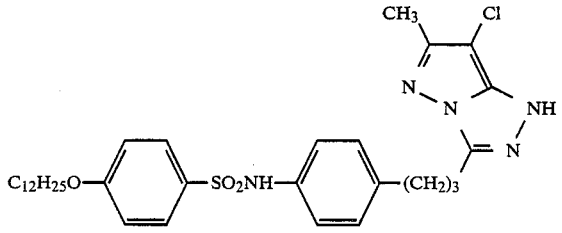
(M-18)
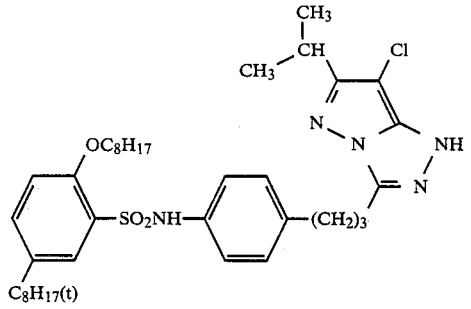
(M-19)
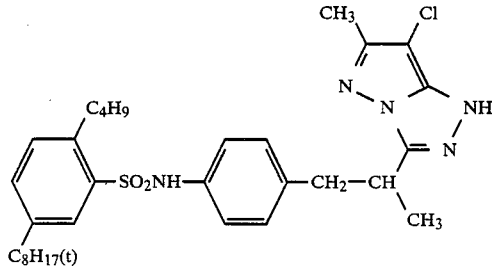

-continued
(M-20)
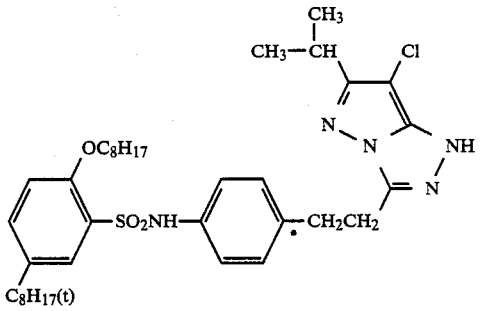
(M-21)
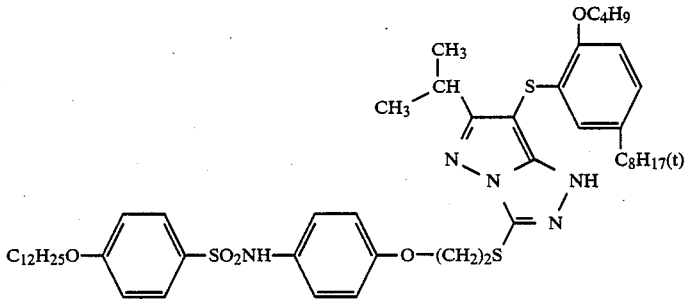
(M-22)
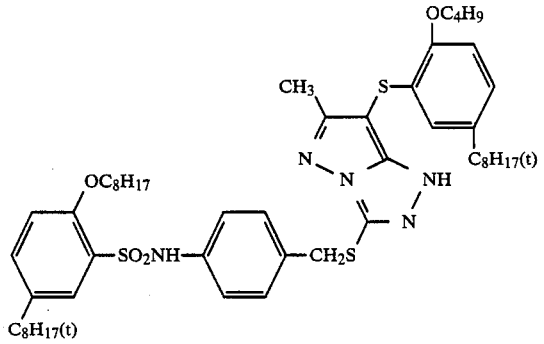
(M-23)
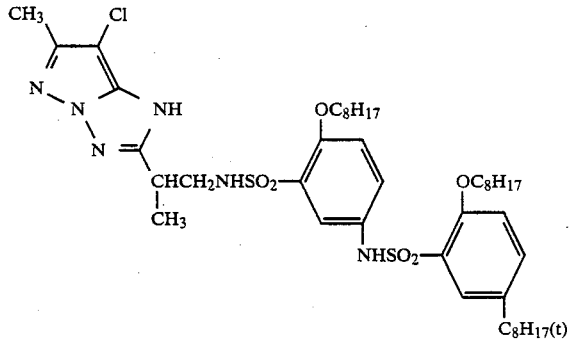
(M-24)
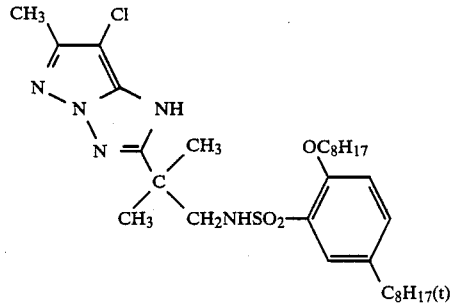

-continued
(M-25)
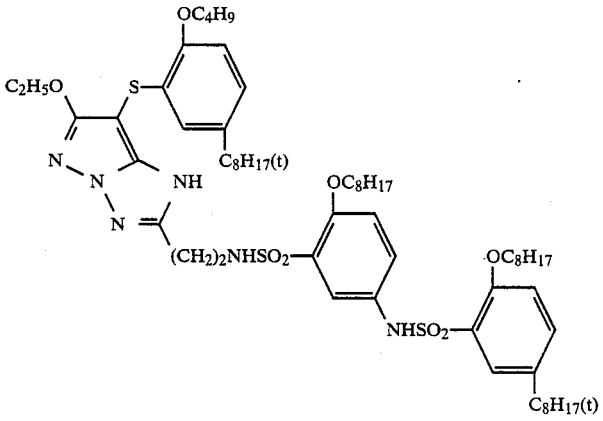
(M-26)
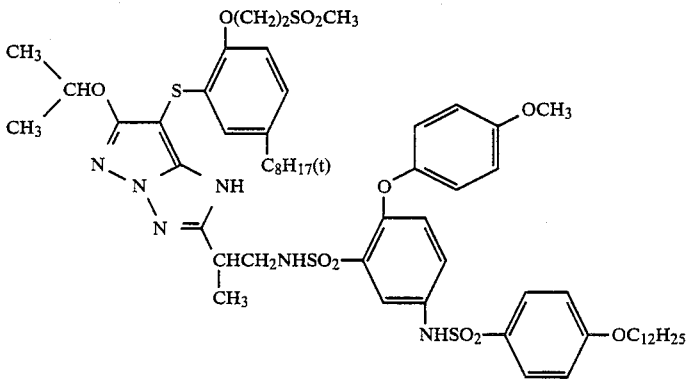
(M-27)
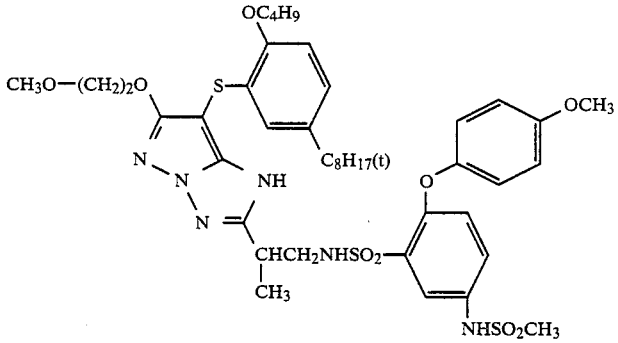
(M-28)
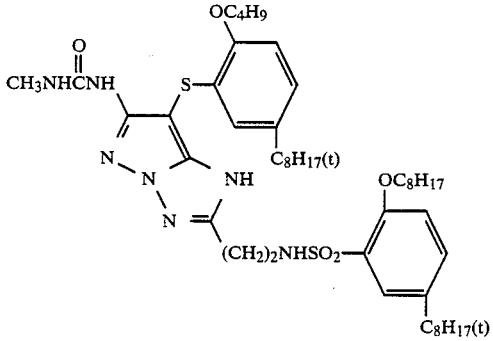

-continued
(M-29)
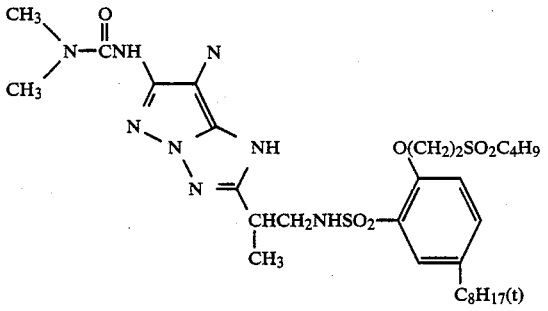
(M-30)
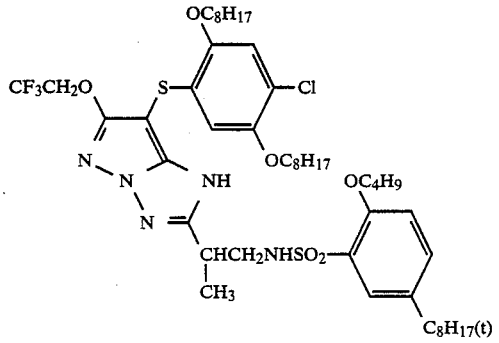
(M-31)
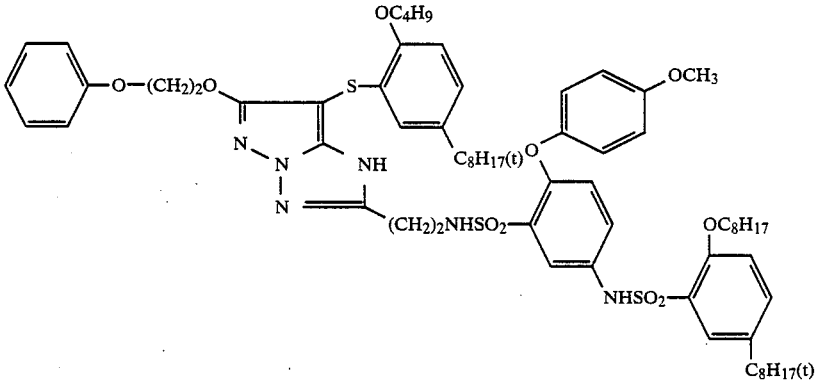
(M-32)
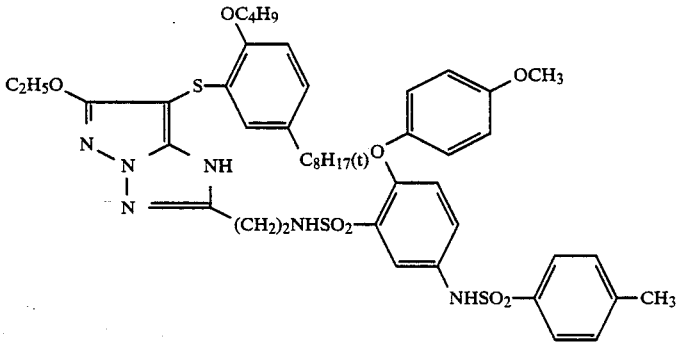

-continued
(M-33)
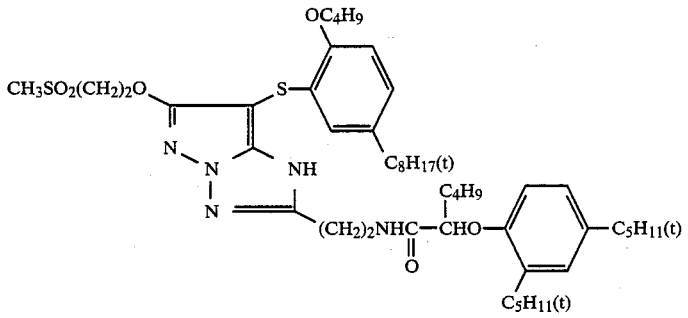
(M-34)
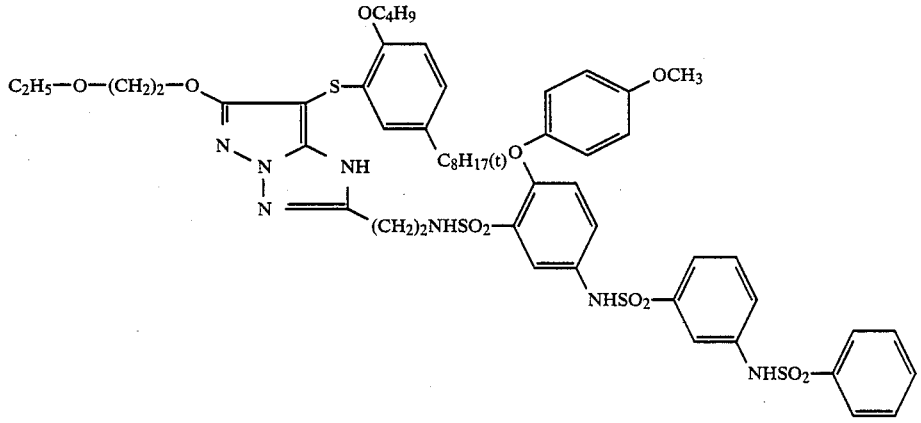
(M-35)
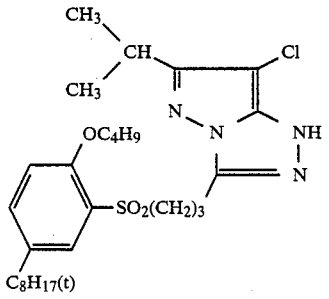
(M-36)
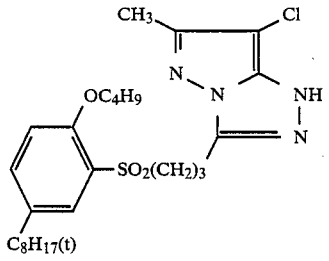
(M-37)
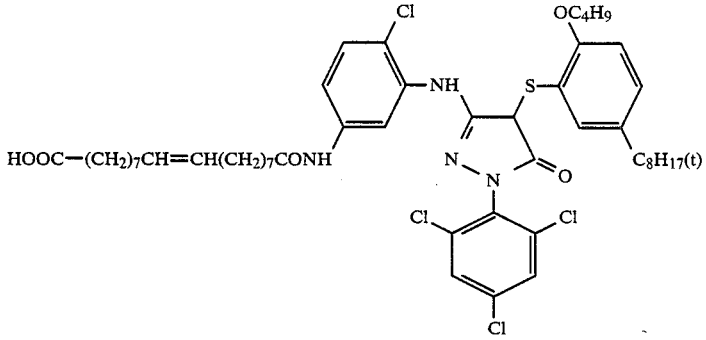

-continued
(M-38)
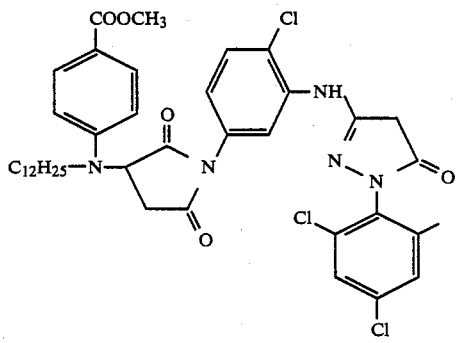
(M-39)
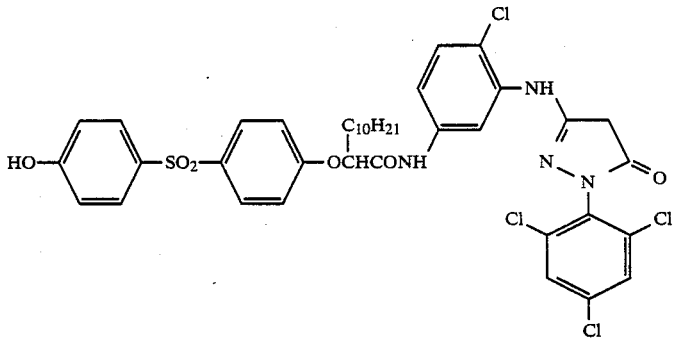
(M-40)
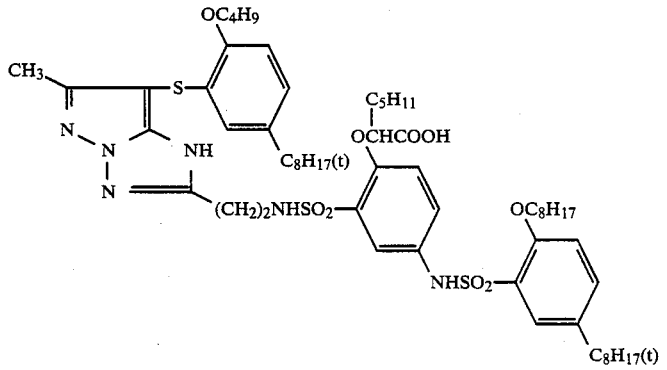
(M-41)
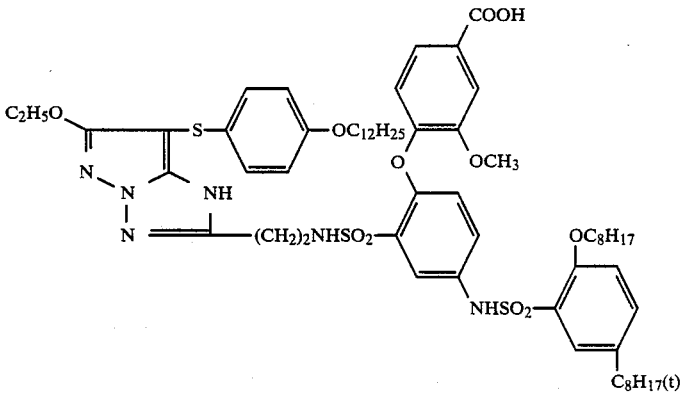

-continued
(M-42)
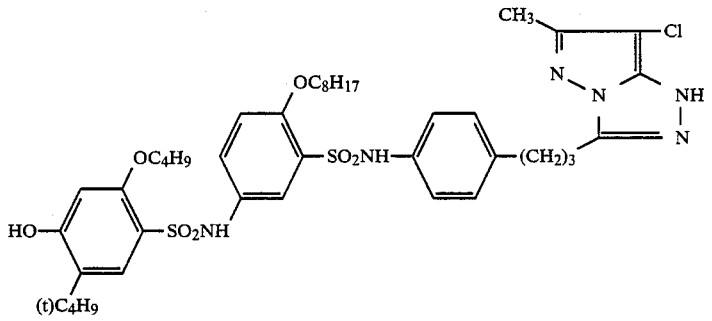
(M-43)
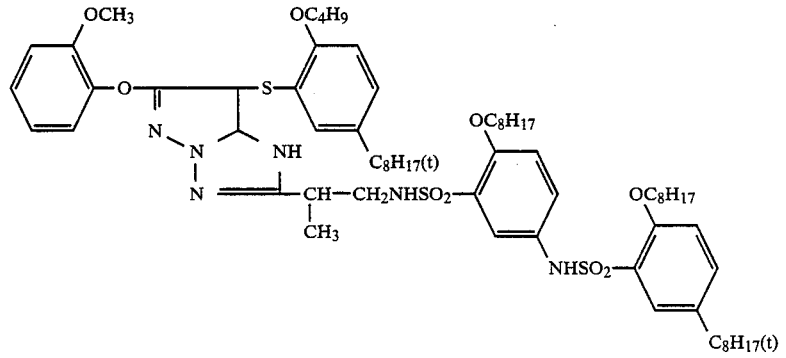
(M-44)
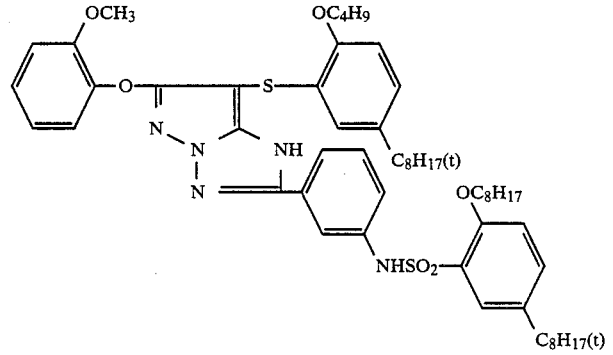
(M-45)
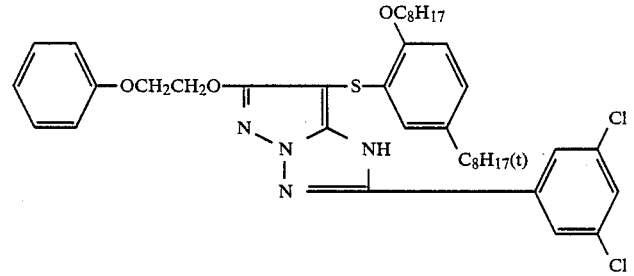
(M-46)
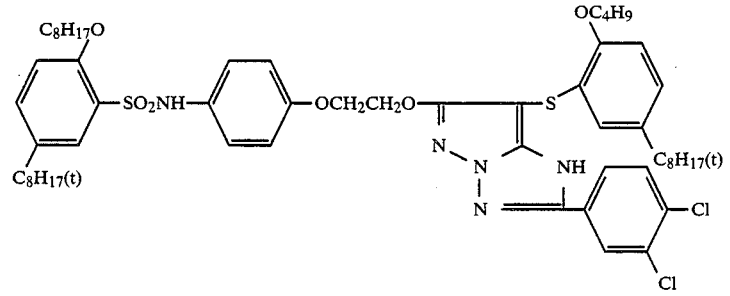

-continued
(M-47)
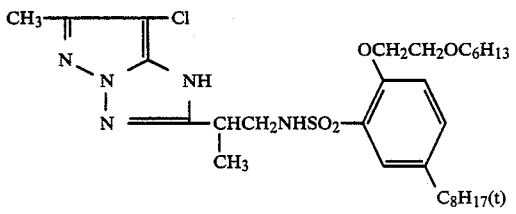
(M-48)
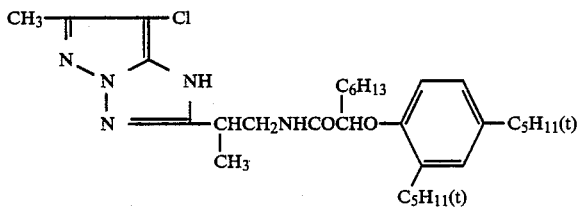
Preferred examples of couplers represented by formula (V) are shown below, but the present invention is not to be construed as being limited thereto.
(Y-1)
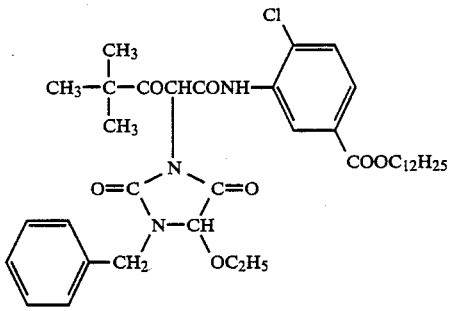
(Y-2)
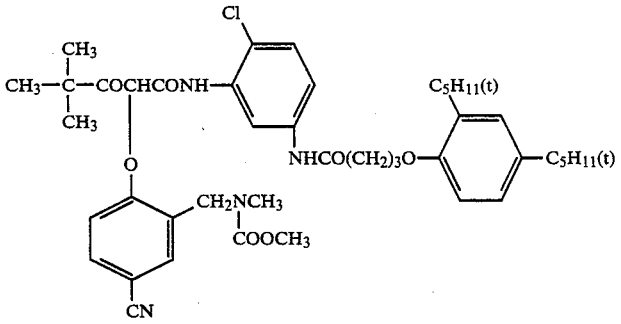
(Y-3)
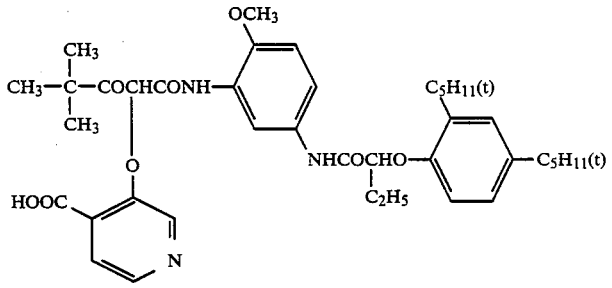

-continued
(Y-4)
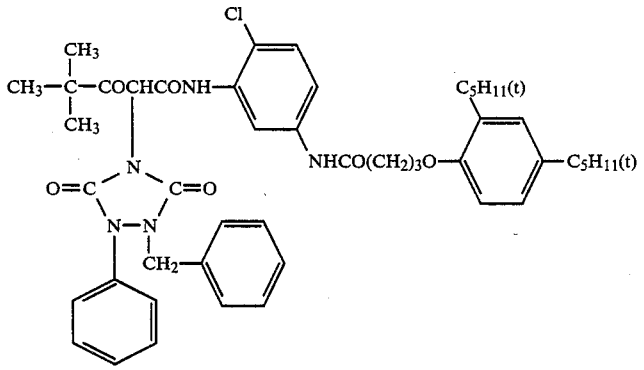
(Y-5)
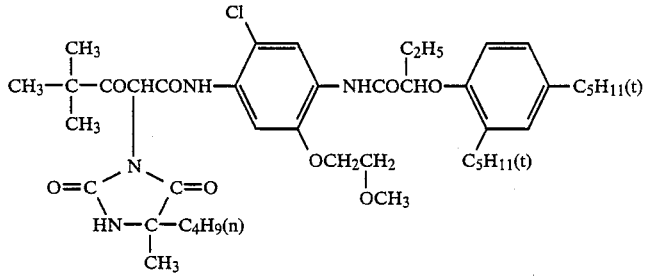
(Y-6)
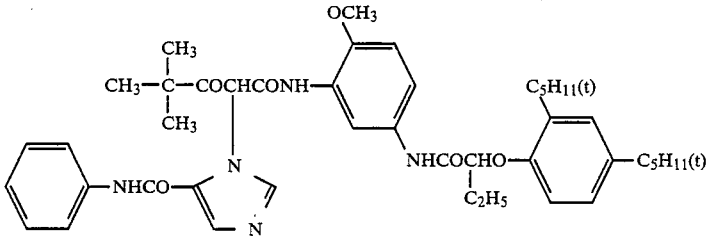
(Y-7)
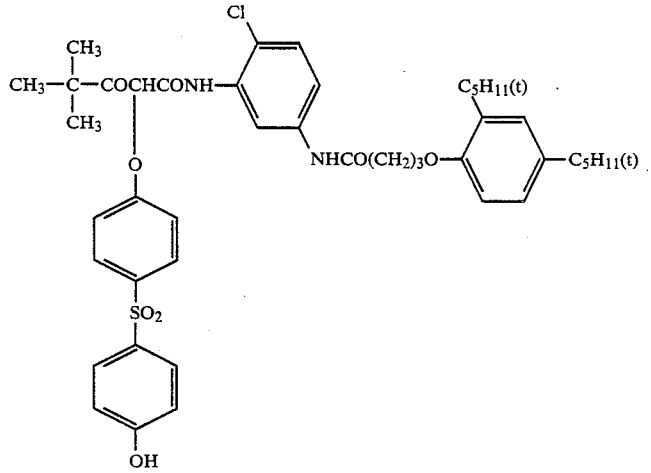

-continued
(Y-8)
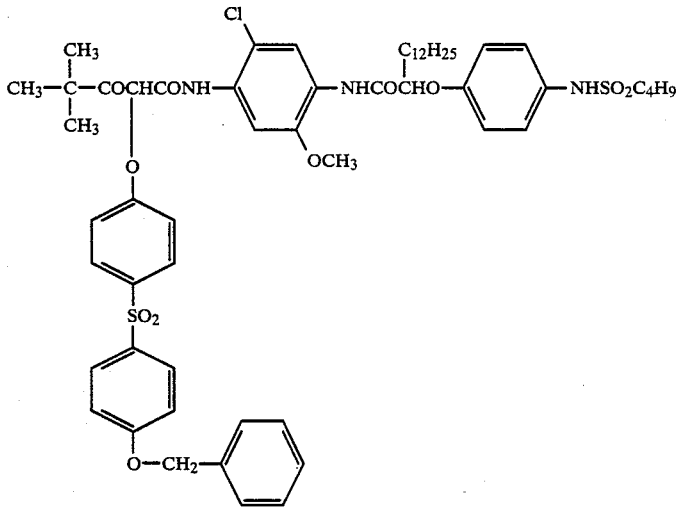
(Y-9)
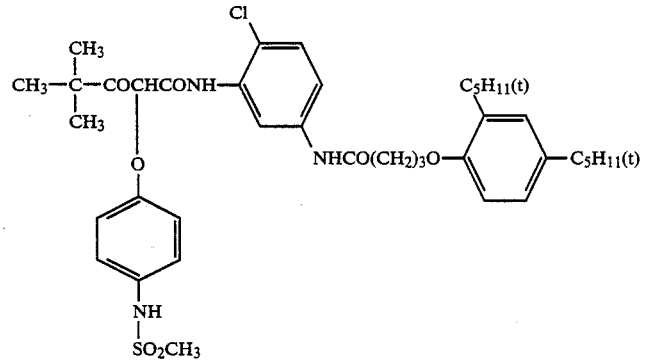
(Y-10)
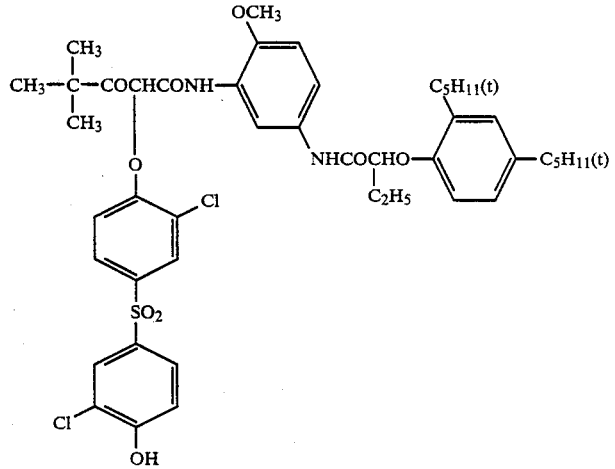

-continued
(Y-11)
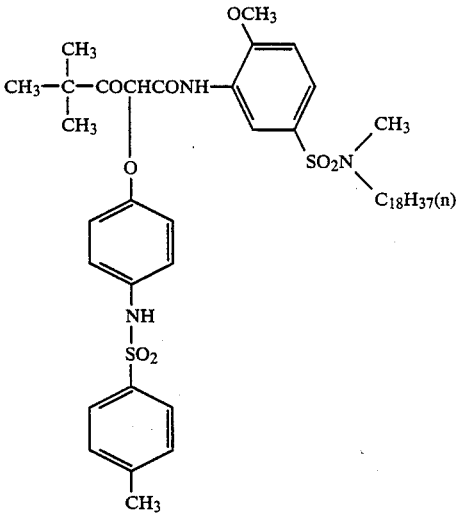
(Y-12)
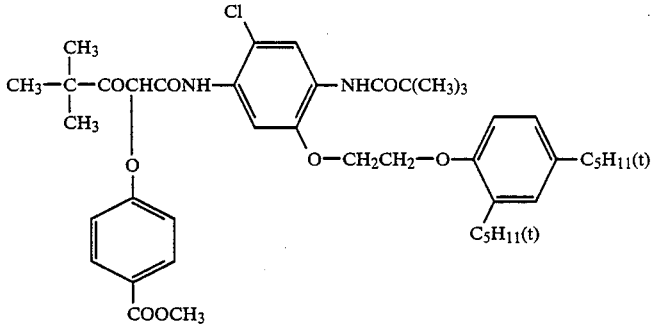
(Y-13)
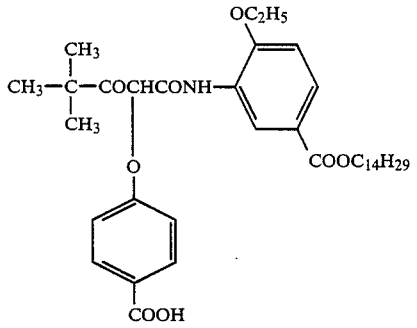
(Y-14)
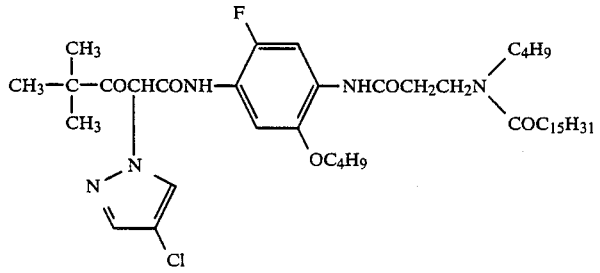

-continued
(Y-15)
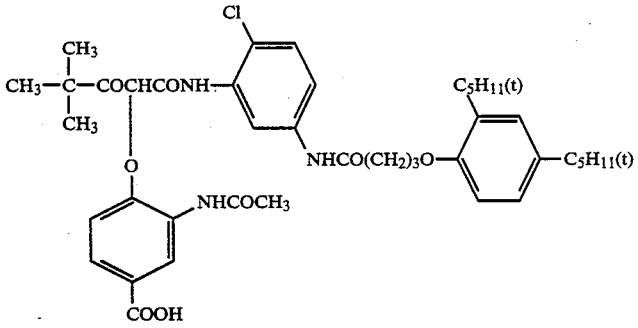
(Y-16)
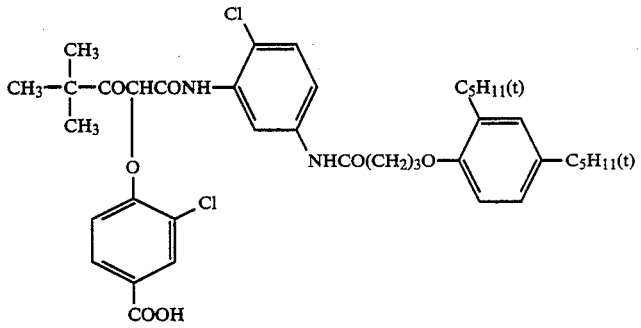
(Y-17)
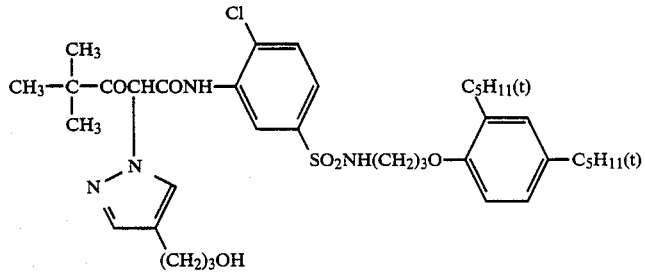
(Y-18)
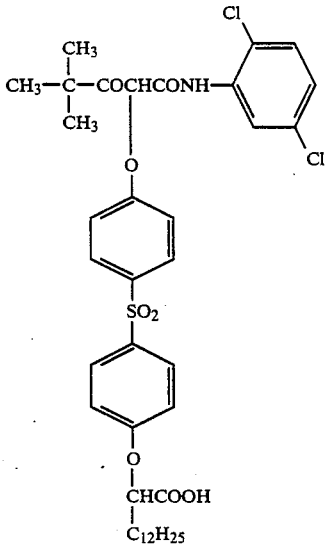

-continued
(Y-19)
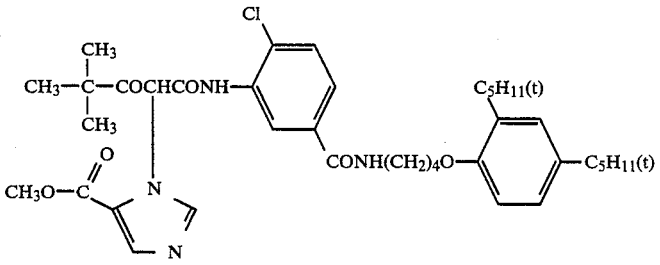
(Y-20)
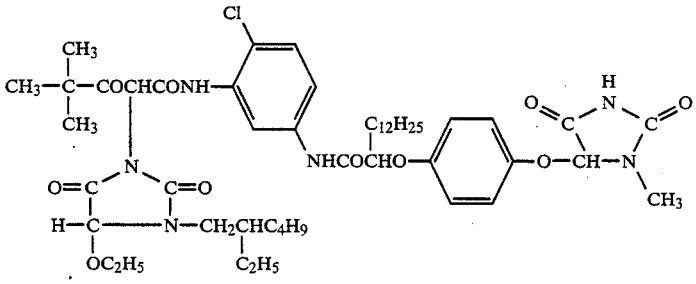
(Y-21)
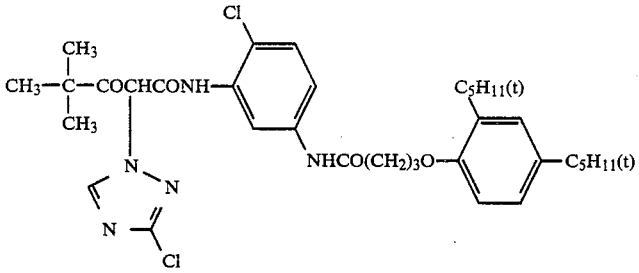
(Y-22)
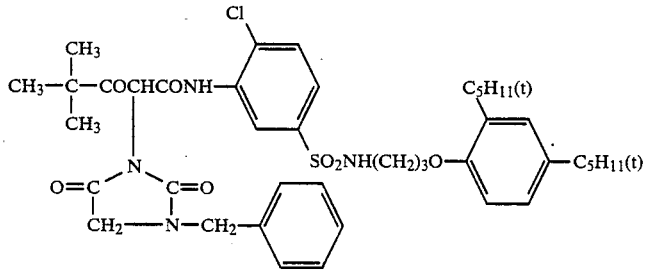
(Y-23)
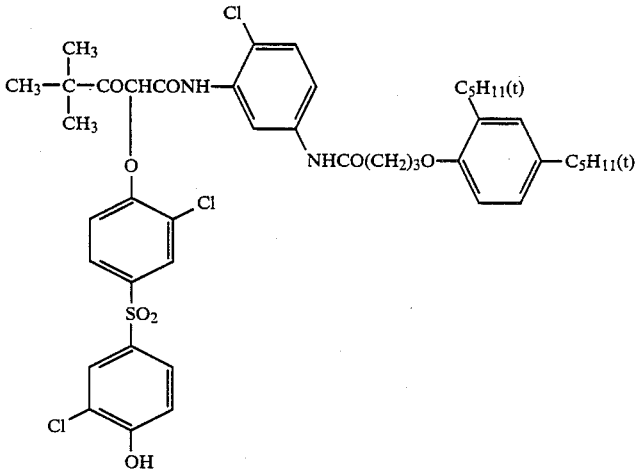

-continued (Y-24)

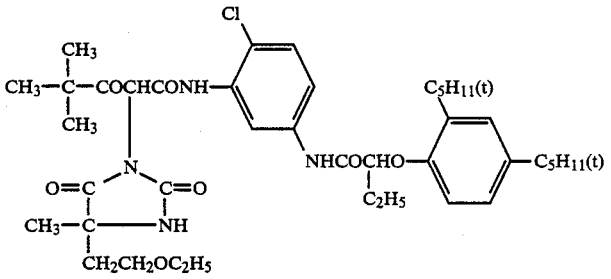

(Y-25)

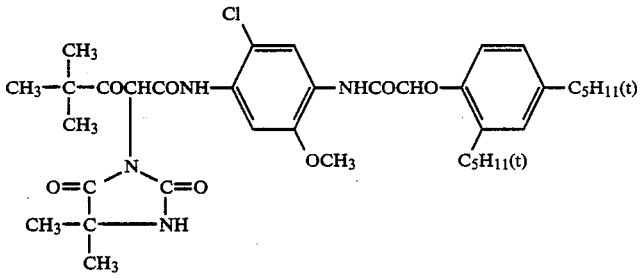

(Y-26)

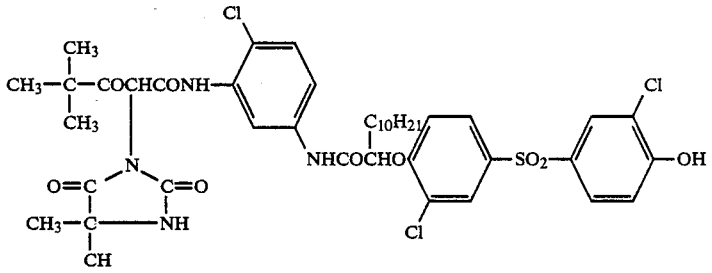

(Y-27)

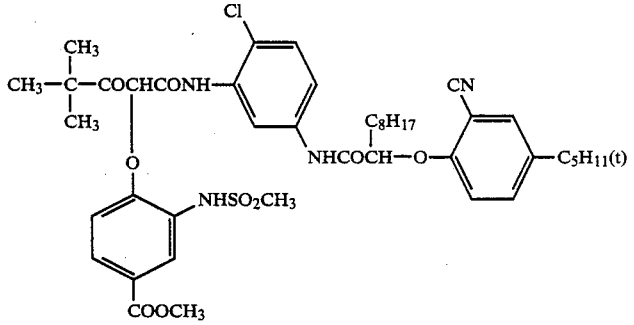

The color couplers which are incorporated into the photosensitive material are preferably rendered fast to diffusion either by having ballast groups or by taking the form of a polymer. 2-Equivalent couplers substituted with a releasing group are preferred to 4-equivalent couplers which have a hydrogen atom at the active coupling position, since they enable the coated weight of silver to be reduced so that the desilvering treatment is facilitated during processing. Couplers forming colored dyes with a suitable degree of diffusibility, non-color-forming couplers or DIR couplers which release a developing inhibitor as the coupling reaction proceeds, BAR couplers which release a desilvering accelerator, and couplers which release developing accelerators, can also be used in the present invention.

Two or more of the various couplers used in the present invention can be used conjointly in the same photosensitive layer in order to provide the characteristics required of the photosensitive material, and the same compounds can also be introduced into two or more different layers.

The amount of color coupler normally used is within the range from 0.001 to 1 mol per mol of photosensitive silver halide, and the amounts used are preferably within the range from 0.01 to 0.5 mol per mol of photosensitive silver halide in the case of the yellow couplers, within the range from 0.003 to 0.3 mol per mol of photosensitive silver halide in the case of the magenta couplers, and within the range from 0.002 to 0.3 mol per mol of photosensitive silver halide in the case of the cyan couplers.

The couplers which are used in the present invention can be introduced into the photosensitive materials using the various known methods of dispersion. Examples of high boiling point solvents which can be used in oil-in-water dispersion methods have been disclosed, for example, in U.S. Pat. No. 2,322,027 and JP-A-No. 62-215272. Low boiling point organic solvents which are insoluble or sparingly soluble in water, including esters such as ethyl acetate, butyl acetate and ketones, for example, can also be used appropriately, as required, in order to increase the solubility of the couplers. Furthermore, the processes and effects of the latex dispersion method, and examples of latexes for loading, have been disclosed, for example, in U.S. Pat. No. 4,199,363, and West German Patent Application (OLS) Nos. 2,541,274 and 2,541,230.

The photographic photosensitive materials used in the present invention are coated on a flexible support such as a plastic film (for example, cellulose nitrate, cellulose acetate, polyethylene terephthalate) or on a rigid support such as glass. Supports and coating methods have been disclosed in detail in *Research Disclosure,* Vol. 176, Item 17643, section XV, (page 27) and section XVII (page 28) (December, 1978).

The use of reflective supports is especially desirable in the present invention.

A "reflective support" is a support which is highly reflective and with which the colored images which are formed in the silver halide emulsion layers are bright, and supports of this type include supports which have been covered with a hydrophobic resin in which a light reflecting substance, such as titanium oxide, zinc oxide, calcium carbonate, or calcium sulfate, has been dispersed, and supports in which a hydrophobic resin in which a light reflecting substance has been dispersed.

The silver halide used in the photosensitive materials used in the present invention may have any halogen composition, including silver iodobromide, silver bromide, silver chlorobromide and silver chloride, for example, but the use of silver chloride emulsions or silver chlorobromide emulsions which contain at least 60 mol % of silver chloride is preferred, and the use of those which have a silver chloride content within the range from 80 to 100 mol % is especially preferable.

The silver halide grains used in the present invention may have different phases in the interior of the grain and the surface region; they may have a multi-phase structure with a junction structure, or the whole grains may consist of a uniform phase. Mixtures of these types can also be used.

The average grain size distribution of the silver halide grains used in the present invention may be narrow or wide, but the use in the present invention of monodispersed silver halide emulsions in which the value (variation coefficient) obtained by dividing the standard deviation of the grain size distribution curve of the silver halide emulsion by the average grain size is within 20%, and particularly within 15%, is preferred. Furthermore, two or more types of monodispersed silver halide emulsions which have different grain sizes can be mixed in the same layer, or lamination coated in separate layers, in emulsion layers which have essentially the same color sensitivity to provide the photosensitive material with the intended gradation. Moreover, mixtures or lamination coatings of two or more types of polydispersed emulsion or combinations of monodispersed and polydispersed emulsions can also be used.

The silver halide grains used in the invention may have a regular crystalline form such as a cubic, octahedral, rhombododecahedral or tetradecahedral form, or they may have an irregular form such as a spherical form, or they may have a mixture of these crystalline forms. They may be tabular grains, and the use of emulsions in which tabular grains of which the value of the length to thickness ratio is from 5 to 8, or greater than 8, account for at least 50% of the projected area of all the grains can be used. Emulsions containing mixtures of these various crystalline forms can also be used. These various types of emulsion may be of the surface latent image type in which the latent image is formed principally on the surface of the grains, or of the internal latent image type in which the latent image is formed principally within the grains.

The photographic emulsions used in the present invention can be adjusted using the methods disclosed in *Research Disclosure,* Item No. 17643, Vol. 176, sections I, II and III (December, 1978).

The emulsion used in the present invention are normally subjected to physical ripening, chemical ripening and spectral sensitization. Additives used in such processes have been disclosed in *Research Disclosure,* No. 17643, Vol. 176 (December, 1978) and in *Research Disclosure,* No. 18716, Vol. 187 (November, 1979), and summarized in the table below.

Known photographically useful additives which can be used in the present invention are also disclosed in the two *Research Disclosures* mentioned above as shown in the table below.

| Type of Additive | RD 17643 | RD 18716 |
|---|---|---|
| 1. Chemical Sensitizers | Page 23 | Page 648, right column |
| 2. Sensitivity Increasing Agents | — | Page 648, right column |
| 3. Spectral Sensitizers | Pages 23–24 | Page 648, right column to page 649, right column |
| 4. Supersensitizers | — | Page 648, right column to page 649, right column |
| 5. Brightening Agents | Page 24 | — |
| 6. Antifoggants and Stabilizers | Pages 24–25 | Page 649, right column |
| 7. Couplers | Page 25 | Page 649, right column |
| 8. Organic Solvents | Page 25 | — |
| 9. Light Absorbers, Filter Dyes, UV Absorbers | Pages 25–26 | Page 649, right column to page 650, left column |
| 10. Antistaining Agents | Page 25, right column | Page 650, left to right columns |
| 11. Dye Image Stabilizers | Page 25 | — |
| 12. Film Hardening Agents | Page 26 | Page 651, left column |
| 13. Binders | Page 26 | Page 651, left column |
| 14. Plasticizers, Lubricants | Page 27 | Page 650, right column |
| 15. Coating Aids, Surfactants | Pages 26–27 | Page 650, right column |
| 16. Antistatic Agents | Page 27 | Page 650, right column |

EXAMPLES

The present invention is now described in greater detail with reference to specific examples, but the present invention is not to be construed as being limited to these examples. Unless otherwise indicated, all parts, percents and ratios are by weight.

EXAMPLE 1

Silver Halide Emulsion (1) for a blue-sensitive silver halide emulsion was prepared in the following way.

| Solution 1 | |
|---|---|
| Water ($H_2O$) | 1,000 ml |

-continued

| | |
|---|---|
| Sodium Chloride (NaCl) | 5.8 g |
| Gelatin | 25 g |
| Solution 2 | |
| Sulfuric Acid (1 N) | 20 ml |
| Solution 3 | |
| Compound indicated below (1 wt %) | 3 ml |

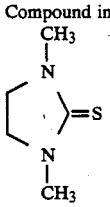

| | |
|---|---|
| Solution 4 | |
| Potassium Bromide (KBr) | 0.18 g |
| Sodium Chloride (NaCl) | 8.51 g |
| Water ($H_2O$) to make | 130 ml |
| Solution 5 | |
| Silver Nitrate ($AgNO_3$) | 25 g |
| Water ($H_2O$) to make | 130 ml |
| Solution 6 | |
| Potassium Bromide (KBr) | 0.70 g |
| Sodium Chloride (NaCl) | 34.05 g |
| $KIrCl_6$ (0.001 wt %) | 2 ml |
| Water ($H_2O$) to make | 285 ml |
| Solution 7 | |
| Silver Nitrate ($AgNO_3$) | 100 g |
| Water ($H_2O$) to make | 285 ml |

Solution 1 was heated to 60° C. and Solutions 2 and 3 were added. Solutions 4 and 5 were then added simultaneously over a period of 60 minutes. After 10 minutes from the completion of the addition of Solutions 4 and 5, Solutions 6 and 7 were added simultaneously over a period of 25 minutes. The temperature was lowered after 5 minutes from the completion of the addition and the emulsion was desalted. Water and dispersed gelatin were added, the pH was adjusted to 6.0, and a monodispersed cubic silver chlorobromide emulsion having average grain size of 1.0 μm, variation coefficient (the value obtained by dividing the standard deviation by the average grain size, $S/\bar{d}$) of 0.11, and the silver bromide content of 1 mol % was obtained. Triethylthiourea was added to this emulsion and the emulsion was chemically sensitized optimally. Subsequently, $7\times10^{-4}$ mol per mol of silver halide of Spectrally Sensitizing Dye (Sen-1) indicated below was added to this emulsion.

Silver Halide Emulsion (2) for the green-sensitive silver halide emulsion layer and Silver Halide Emulsion (3) for the red-sensitive silver halide emulsion layer were prepared using the same method as described above but the amounts of the reagents added, the temperature and the addition times were altered in each case.

Spectrally Sensitizing Dye (Sen-2) was added at a rate of $5\times10^{-4}$ mol per mol of emulsion to Silver Halide Emulsion (2) and Sensitizing Dye (Sen-3) was added at a rate of $0.9\times10^{-4}$ mol per mol of emulsion to Silver Halide Emulsion (3).

The form, average grain size, halogen composition and variation coefficient for each of Silver Halide Emulsions (1) to (3) were as shown below.

| Emulsion | Form | Average Grain Size (μm) | Halogen Composition (mol % Br) | Variation Coefficient |
|---|---|---|---|---|
| (1) | Cubic | 1.00 | 1.0 | 0.11 |
| (2) | Cubic | 0.45 | 1.0 | 0.09 |
| (3) | Cubic | 0.34 | 1.8 | 0.10 |

(Sen-1)

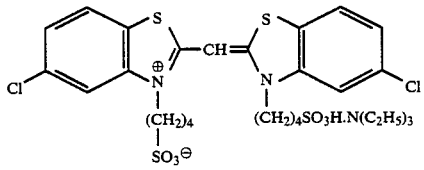

(Sen-2)

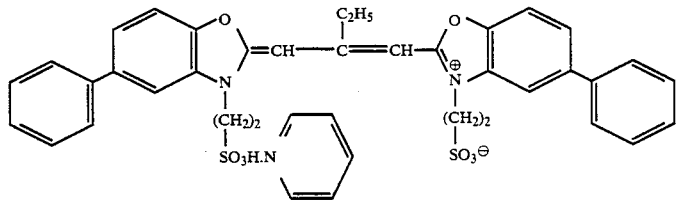

(Sen-3)

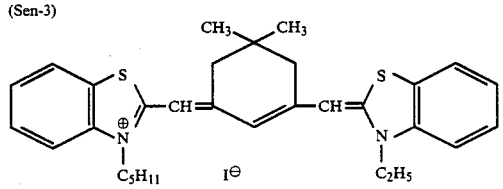

A multilayer color photographic material of which the layer structure is indicated below was prepared using Silver Halide Emulsions (1) to (3). The coating solutions were prepared in the following way.

Preparation of the First Layer Coating Solution

Ethyl acetate (27.2 ml) and 3.8 ml of Solvent (Solv-1) were added to 19.1 g of Yellow Coupler (Y-35) to form a solution which was subsequently emulsified and dispersed in 185 ml of 10 wt % aqueous gelatin solution which contained 8 ml of 10 wt % sodium dodecylbenzenesulfonate. Moreover, an emulsion was prepared separately by adding $5.0\times10^{-4}$ mol per mol of silver of the blue-sensitive Sensitizing Dye (Sen-1) to Silver Halide Emulsion (1). The aforementioned emulsified emulsion was then mixed wit this emulsion to provide a first layer coating solution of which the composition was as indicated below.

The coating solution for the second to the seventh layers were prepared using the same procedure as used for the first layer coating solution.

Moreover, 1-oxy-3,5-dichloro-s-triazine, sodium salt, was used as a gelatin hardening agent in each layer. The compound indicated below was added at a rate of $1.9\times10^{-3}$ mol per mol of silver halide to the red-sensitive emulsion layer.

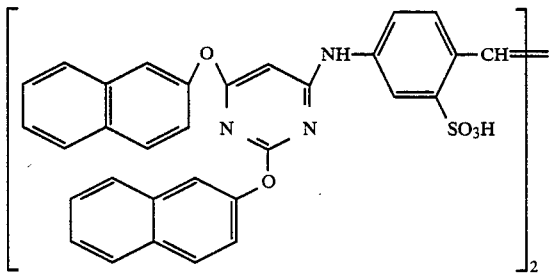

Furthermore, 4-hydroxy-6-methyl-1,3,3a,7-tetraazaindene was added at a rate of $1.0\times10^{-2}$ mol per mol of silver halide to the blue-sensitive emulsion layer.

Furthermore, 1-(5-methylureidophenyl)-5-mercaptotetrazole was added to the blue-sensitive and green-sensitive emulsion layers at rates of $1.0\times10^{-3}$ mol, and $1.5\times10^{-3}$ mol, per mol of silver halide, respectively.

Furthermore, 2-amino-5-mercapto-1,3,4-thiadiazole was added at a rate of $2.5\times10^{-4}$ mol per mol of silver halide to the red-sensitive emulsion layer.

The composition of each layer is indicated below.

Layer Compositions

Support

A paper support laminated on both sides with polyethylene. A white pigment, $TiO_2$ (2.7 g/m$^2$) and a bluish dye (ultramarine) were included in the polyethylene on the first layer side.

| | |
|---|---|
| First Layer: Blue-Sensitive Layer | |
| Silver Halide Emulsion (1) | 0.26 g/m$^2$ |
| Gelatin | 1.13 g/m$^2$ |
| Yellow Coupler (Y-35) | 0.66 g/m$^2$ |
| Solvent (Solv-1) | 0.28 g/m$^2$ |
| Second Layer: Anti-Color-Mixing Layer | |
| Gelatin | 0.89 g/m$^2$ |
| Anti-color-Mixing Agent (Cpd-1) | 0.08 g/m$^2$ |
| Solvent (Solv-1) | 0.20 g/m$^2$ |
| Solvent (Solv-2) | 0.20 g/m$^2$ |
| Dye (T-1) | 0.005 g/m$^2$ |
| Third Layer: Green-Sensitive Layer | |
| Silver Halide Emulsion (2) | 0.15 g/m$^2$ |
| Gelatin | 0.99 g/m$^2$ |
| Magenta Coupler (M-44) | 0.27 g/m$^2$ |
| Colored Image Stabilizer (Cpd-2) | 0.10 g/m$^2$ |
| Colored Image Stabilizer (Cpd-3) | 0.02 g/m$^2$ |
| Colored Image Stabilizer (Cpd-4) | 0.01 g/m$^2$ |
| Solvent (Solv-2) | 0.19 g/m$^2$ |
| Solvent (Solv-3) | 0.15 g/m$^2$ |
| Fourth Layer: Ultraviolet Absorbing Layer | |
| Gelatin | 1.42 g/m$^2$ |
| Ultraviolet Absorber (UV-1) | 0.52 g/m$^2$ |
| Anti-Color-Mixing Agent (Cpd-1) | 0.06 g/m$^2$ |
| Solvent (Solv-4) | 0.26 g/m$^2$ |
| Dye (T-2) | 0.015 g/m$^2$ |
| Fifth Layer: Red-Sensitive Layer | |
| Silver Halide Emulsion (3) | 0.22 g/m$^2$ |
| Gelatin | 1.06 g/m$^2$ |
| Cyan Coupler (C-2) | 0.37 g/m$^2$ |
| Colored Image Stabilizer (Cpd-6) | 0.32 g/m$^2$ |
| Colored Image Stabilizer (Cpd-7) | 0.18 g/m$^2$ |
| Solvent (Solv-4) | 0.10 g/m$^2$ |
| Solvent (Solv-5) | 0.10 g/m$^2$ |
| Solvent (Solv-6) | 0.11 g/m$^2$ |
| Sixth Layer: Ultraviolet Absorbing Layer | |
| Gelatin | 0.48 g/m$^2$ |
| Ultraviolet Absorber (UV-1) | 0.18 g/m$^2$ |
| Solvent (Solv-4) | 0.08 g/m$^2$ |
| Dye (T-2) | 0.005 g/m$^2$ |
| Seventh Layer: Protective Layer | |
| Gelatin | 1.33 g/m$^2$ |
| Acrylic Modified Poly(vinyl alcohol) Copolymer (17% modification) | 0.05 g/m$^2$ |
| Liquid Paraffin | 0.03 g/m$^2$ |

The structural formulae of the compounds used are indicated below.

(Cpd-1) Anti-Color-Mixing Agent

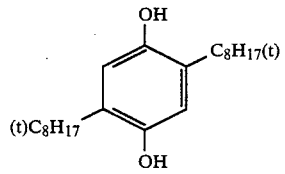

(Cpd-2) Colored Image Stabilizer

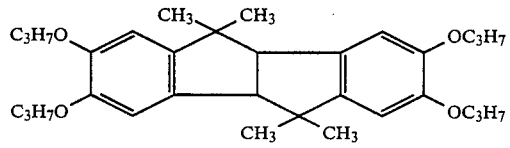

(Cpd-3) Colored Image Stabilizer

-continued
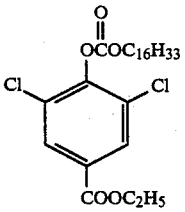
(Cpd-4) Colored Image Stabilizer
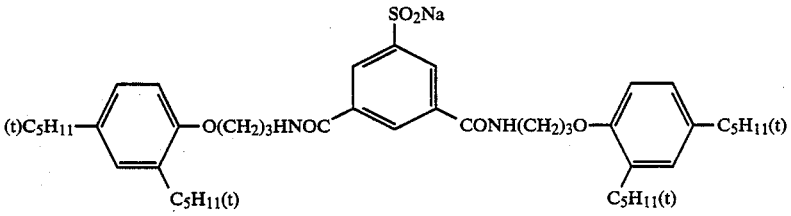
(Cpd-6) Colored Image Stabilizer
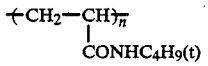
Average Molecular Weight: 60,000
(Cpd-7) Colored Image Stabilizer
A 4/2/5 (by weight) mixture of:
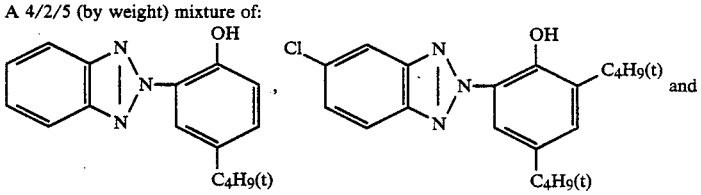
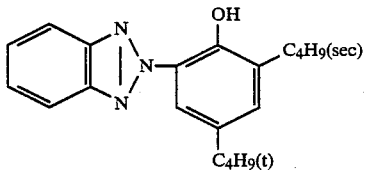
(UV-1) Ultraviolet Absorber
A 12/10/3 (by weight) mixture of:
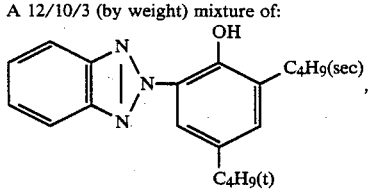
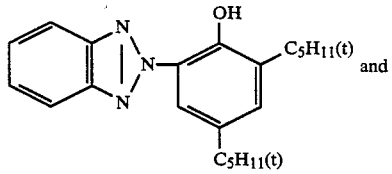
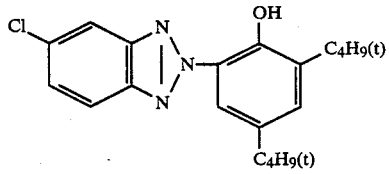

-continued
(Solv-1) Solvent
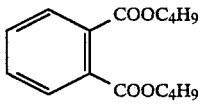
(Solv-2) Solvent
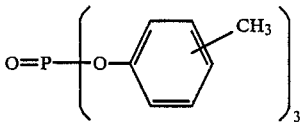
(Solv-3) Solvent
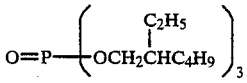
(Solv-4) Solvent
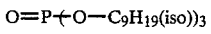
(Solv-5) Solvent
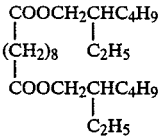
(Solv-6) Solvent
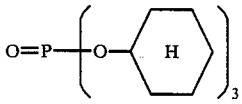
(T-1)
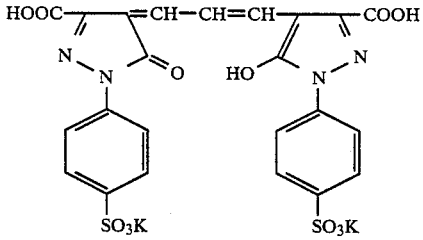
(T-2)
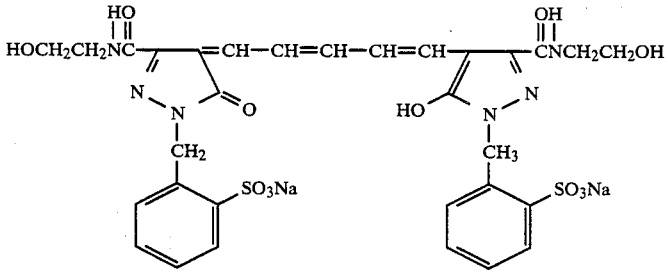
The sample prepared in the way described above was Sample 01.
Next, two parts, namely, Part A and Part B, of a blixing solution concentrate composition for silver halide color photographic materials of the present invention was prepared using the formulation indicated below.

| | |
|---|---|
| Part A | |
| Ammonium Thiosulfate (700 g/liter) | 1,000 ml |
| EDTA $2Na.2H_2O$ | 5.0 g |
| Sodium Bisulfite | 85.3 g |
| Sodium Sulfite | 291.0 g |
| Water to make | 2 liters |
| pH | 6.5 |
| Part B | |
| EDTA Fe(III) $NH_4$ (500 g/liter) | 1,100 g |
| EDTA | 30 g |
| Ammonium Bromide | 300 g |
| Nitric Acid (67 wt %) and KOH (50 wt %) (pH adjustment see Table 1) | |
| Water to make | 2 liters |

The pH of Part B of the concentrate composition was adjusted as shown in Table 1 using nitric acid (67 wt %) or potassium hydroxide (50 wt %).

TABLE 1

| Part B Test Liquid | Adjusted pH | Remarks |
|---|---|---|
| B-1 | 0.2 | Invention |
| B-2 | 0.4 | Invention |
| B-3 | 1.0 | Invention |
| B-4 | 2.0 | Comparison |
| B-5 | 3.0 | Comparison |
| B-6 | 4.0 | Comparison |
| B-7 | 6.0 | Comparison |

Color development processing was carried out using the processes and processing formulations indicated below in order to evaluate photographic performance in connection with the present invention.

| Processing Step | Processing Temperature (°C.) | Processing Time (sec) |
|---|---|---|
| Color Development (CD) | 35 | 45 |
| Bleach-Fixing (Blixing) | 35 | 45 |
| Water Washing | 27–35 | 90 |
| Drying | 70–80 | 60 |
| Color Developing Solution: | | |
| Triethanolamine | | 8.0 g |
| Diethylhydroxylamine | | 4.2 g |
| Brightening Agent ("Unitex CK", manufactured by Ciba-Geigy) | | 2.8 g |
| Sodium Chloride | | 0.77 g |
| Sodium Sulfite | | 0.135 g |
| 4-Amino-3-methyl-N-ethyl-N-[β-(methanesulfonamido)ethyl]aniline Sulfate Hydrate | | 5.0 g |
| Potassium Carbonate | | 18.4 g |
| Ethylenediamine-N,N,N',N'-tetramethylenephosphonic Acid | | 3.0 g |
| Starter Liquid* | | 50 ml |
| Water to make | | 1 liter |
| pH | | 10.05 |

*Starter Liquid

| | |
|---|---|
| Sodium Chloride | 1.29 g |
| Potassium Carbonate | 0.30 g |
| Sodium Bicarbonate | 3.91 g |
| Ion Exchanged Water | 50 ml |
| pH | 8.20 |

For the bleach-fixing solution, 200 ml quantities of Part A and Part B of the concentrate composition were measured out, 600 ml of water was added, and the pH was adjusted to 5.5 using the nitric acid (67 wt. %) or potassium hydroxide (50 wt. %) as mentioned earlier for use.

Test 1

The blixing concentrate Part B Compositions shown in Table 1 for Tests 1 to 7 were placed in sealed polyvinyl containers and the aging stability was tested by leaving these containers to stand for 1 month under conditions of −5° C. The results obtained were as shown in Table 2.

TABLE 2

| Part B Test Liquid | pH Value | State after Aging at −5° C. for 1 Month | Remarks |
|---|---|---|---|
| B-1 | 0.2 | Clear, dark liquid | Invention |
| B-2 | 0.4 | Clear, dark liquid | Invention |
| B-3 | 1.0 | Clear, dark liquid | Invention |
| B-4 | 2.0 | Slight yellow sediment | Comparison |
| B-5 | 3.0 | Yellow sediment | Comparison |
| B-6 | 4.0 | Yellow sediment | Comparison |
| B-7 | 6.0 | Clear, dark liquid | Comparison |

Test 2

Part B, Test Samples 1 to 7, of the blixing concentrate compositions described earlier were introduced into sealed polyvinyl containers and left to stand for 2 months under conditions of 40° C. to test their aging stability. No sediment or turbidity was observed in any of the seven test liquids. Next, 200 ml of each liquid was mixed with 200 ml of Part A Liquid described earlier and 600 ml of water was added, after which the pH was adjusted to 5.5 using nitric acid (67 wt %) or potassium hydroxide (50 wt %) to provide a blixing solution for use.

The coated Sample 01 silver halide color photographic material described earlier was subjected to a B-G-R tricolor separation wedge exposure and processed using the color development processing described earlier. The difference in the maximum densities (Dm) using the cyan color density was measured as shown in Table 3 and the color turbidity difference was observed in the high density parts.

TABLE 3

| Part B Test Liquid | pH of the Part B Test Liquid | $D_{max}$ of the Red-Sensitive Layer (RL) | Remarks |
|---|---|---|---|
| B-1 | 0.2 | 2.53 | Invention |
| B-2 | 0.4 | 2.54 | Invention |
| B-3 | 1.0 | 2.54 | Invention |
| B-4 | 2.0 | 2.48 | Comparison |
| B-5 | 3.0 | 2.40 | Comparison |
| B-6 | 4.0 | 2.31 | Comparison |
| B-7 | 6.0 | 2.20 | Comparison |

The color turbidity was measured by exposing to white light of 20 CMS, processing the samples in the same way as before and estimating the amount of residual silver after processing using X-ray fluorescence, and the results obtained were as shown in Table 4.

TABLE 4

| Part B Test Liquid | pH of the Part B Test Liquid | Residual Silver ($\mu m/cm^2$) | Remarks |
|---|---|---|---|
| B-1 | 0.2 | 3.0 | Invention |
| B-2 | 0.4 | 2.8 | Invention |
| B-3 | 1.0 | 3.1 | Invention |
| B-4 | 2.0 | 6.7 | Comparison |
| B-5 | 3.0 | 8.9 | Comparison |

TABLE 4-continued

| Part B Test Liquid | pH of the Part B Test Liquid | Residual Silver ($\mu m/cm^2$) | Remarks |
|---|---|---|---|
| B-6 | 4.0 | 11.5 | Comparison |
| B-7 | 6.0 | 15.6 | Comparison |

It is clearly seen from the results of Tests 1 and 2 shown in Tables 2 to 4 that with a concentrate composition of the present invention in which the blixing solution concentrate composition is divided into two parts and the pH of one of these parts (Part B) is not more than 1.5, there is no crystallization at low temperature and the liquid has excellent stability on aging at high temperature, and the composition exhibits a satisfactory bleach-fixing performance.

On the other hand, when the pH of Part B Concentrate Composition is high (pH 6.0), the aging stability at low temperature is good but on aging at high temperatures the desilvering properties become inadequate and color turbidity arises, and there is a marked lowering of the cyan color-forming ability. Without being bound by theory, it is thought that this is due to the fact that on aging at elevated temperatures some of the EDTA Fe(III) is converted to EDTA Fe(II) so that the oxidizing power of the bleach is reduced, with the result that the conversion of $Ag^0 \rightarrow Ag^+$ is incomplete and a large amount of residual silver is left behind, and because of the formation of a leuco form of the cyan dye. Furthermore, there is a serious disadvantage with the liquids in which the pH of Part B Concentrate Composition is within the range from 2 to 4 in respect of the low temperature aging stability in that crystallization occurs. This is clearly disadvantageous in respect of the supply of a stable liquid and from the point of view of reducing costs.

EXAMPLE 2

Samples were prepared using the same method as used for Sample 01 except that the layers forming Sample 01 were changed as indicated below.

First Layer

Yellow Coupler (Y-36) substituted on an equimolar basis.

| Third Layer (green-sensitive layer) | |
|---|---|
| Silver Halide Emulsion Layer (2) | 0.20 $g/m^2$ |
| Gelatin | 1.32 $g/m^2$ |
| Magenta Coupler (M-14) (substituted on an equimolar basis) | |
| Anti-Color-Mixing Agent (Cpd-2) | 0.15 $g/m^2$ |
| Anti-Color-Mixing Agent (Cpd-8) | 0.05 $g/m^2$ |
| Anti-Color-Mixing Agent (Cpd-9) | 0.07 $g/m^2$ |
| Anti-Color-Mixing Agent (Cpd-5) | 0.01 $g/m^2$ |
| Anti-Color-Mixing Agent (Cpd-10) | 0.33 $g/m^2$ |
| Solvent (Solv-2) | 0.20 $g/m^2$ |
| Solvent (Solv-3) | 0.10 $g/m^2$ |

Fifth Layer

Cyan Couplers (C-29/C-2=1/1 molar ratio)
(the total amount being substituted on an equimaolar basis)

The others are the same as Sample 01.

The sample was prepared by the same manner as Sample 01 except that the third layer and fifth layer were changed as described above.

The silver halide photographic material prepared in this way was Sample 02. Samples in which the couplers of the red-sensitive layer, green-sensitive layer and blue-sensitive layer had been replaced on an equimolar basis, as shown in Table 5, were also prepared. These were Samples 03 to 16. With the proviso that when Couplers (M-47) and (M-24) were used in the green-sensitive layer, the photographic materials comprising a constitution layer having the third layer according to Sample 01 were prepared except that Coupler (M-47) or Coupler (M-24) was used in the third layer.

(Cpd-5) Anti-Color-Mixing Agent

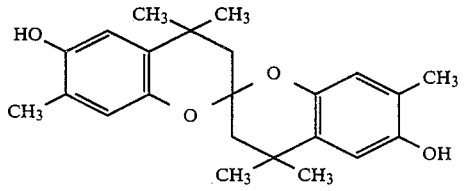

(Cpd-8) Anti-Color-Mixing Agent

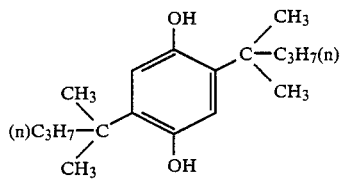

(Cpd-9) Anti-Color-Mixing Agent

-continued

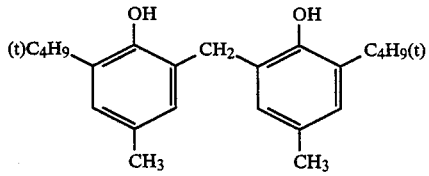

(Cpd-10) Anti-Color-Mixing Agent

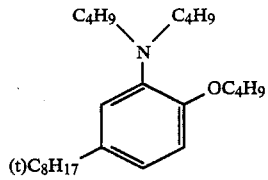

Comparative Coupler 1

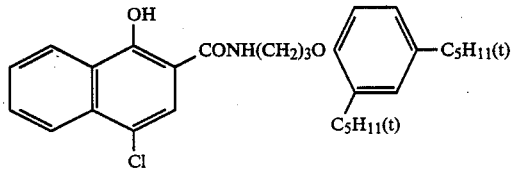

Comparative Coupler 2

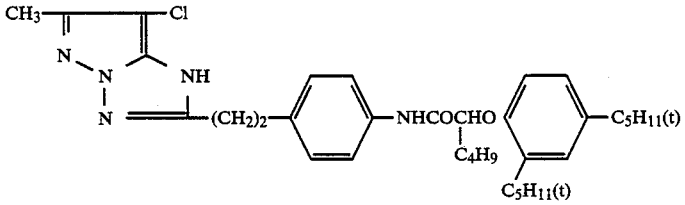

Comparative Coupler 3

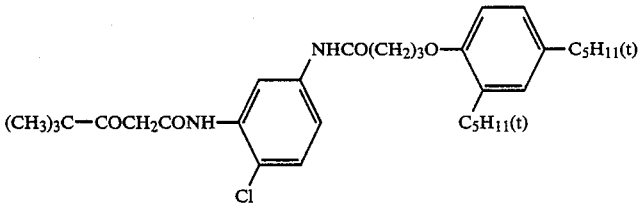

TABLE 5

| Sample No. | Coupler Red-Sensitive Layer | Green-Sensitive Layer | Blue-Sensitive Layer |
|---|---|---|---|
| 02 | C-29, C-2 | M-14 | Y-36 |
| 03 | C-2 | M-14 | Y-36 |
| 04 | C-6 | M-14 | Y-36 |
| 05 | C-8 | M-14 | Y-36 |
| 06 | C-16 | M-14 | Y-36 |
| 07 | C-27 | M-14 | Y-36 |
| 08 | C-41 | M-14 | Y-36 |
| 09 | C-29 | M-14 | Y-36 |
| 10 | C-2 | M-47 | Y-35 |
| 11 | C-2 | M-24 | Y-35 |
| 12 | C-2 | M-14 | Y-39 |
| 13 | C-29 | M-47 | Y-35 |
| 14 | C-29 | M-24 | Y-35 |
| 15 | C-29 | M-14 | Y-35 |
| 16 | Comparative Coupler 1 | Comparative Coupler 2 | Comparative Coupler 3 |

Samples 02 to 16 prepared in this way were exposed using a B-G-R tricolor separation filter fitted wedge, after which they were processed in the same way as described in Example 1. The formulation of the color development bath and the water washing and drying conditions used at this time were exactly the same as those used in Example 1.

Bleach-fixing solutions were prepared for use using Part B Solutions B-2 and B-6 described in Example 1 after they had been stored and aged for 4 weeks at 40° C. by mixing with Part A described in Example 1, diluting with water and adjusting to pH 5.5.

Density measurements were carried out immediately using the samples which had been developed and processed in this way. Once the density measurement had been made, the samples were immersed for 60 seconds in a 1 wt % potassium ferricyanide solution of pH 7.0 at 35° C. and rinsed with water for 90 seconds, this being repeated three times, and then the samples were resubmitted for density measurements. The changes in the maximum cyan densities were as shown in Table 6.

TABLE 6

| Sample No. | Maximum Cyan Density ($D_{max}$) Part B (B-2, pH = 0.4) Immediately after Being Processed (Invention) | Part B (B-2, pH = 0.4) After Being Treated by Ferricyanide (Comparison) | Part B (B-6, pH = 4.0) Immediately after Being Processed (Comparison) | Part B (B-6, pH = 4.0) After Being Treated by Ferricyanide (Comparison) | Remarks |
|---|---|---|---|---|---|
| 02 | 2.51 | 2.57 | 2.30 | 2.56 | Couplers of the Present Invention |
| 03 | 2.54 | 2.54 | 2.43 | 2.54 | Couplers of the Present Invention |
| 04 | 2.51 | 2.52 | 2.44 | 2.52 | Couplers of the Present Invention |
| 05 | 2.55 | 2.55 | 2.46 | 2.55 | Couplers of the Present Invention |
| 06 | 2.47 | 2.50 | 2.37 | 2.51 | Couplers of the Present Invention |
| 07 | 2.49 | 2.53 | 2.39 | 2.53 | Couplers of the Present Invention |
| 08 | 2.53 | 2.56 | 2.40 | 2.56 | Couplers of the Present Invention |
| 09 | 2.52 | 2.62 | 2.20 | 2.61 | Couplers of the Present Invention |
| 10 | 2.53 | 2.54 | 2.42 | 2.54 | Couplers of the Present Invention |
| 11 | 2.53 | 2.53 | 2.43 | 2.54 | Couplers of the Present Invention |
| 12 | 2.54 | 2.54 | 2.43 | 2.54 | Couplers of the Present Invention |
| 13 | 2.53 | 2.63 | 2.19 | 2.62 | Couplers of the Present Invention |
| 14 | 2.52 | 2.63 | 2.21 | 2.63 | Couplers of the Present Invention |
| 15 | 2.52 | 2.62 | 2.20 | 2.62 | Couplers of the Present Invention |
| 16 | 2.13 | 2.38 | 1.98 | 2.40 | Comparative Material |

It is clearly seen from the results shown in Table 6 that, relative to the effect seen on using the blixing solution obtained using Part B of the concentrate composition of the present invention which had a low pH value of 0.4, the effect of using a blixing solution obtained using Part B of pH 4.0 was to produce a distinct density difference in the maximum cyan densities, a difference in the saturation of the color of the image part in the region of the highest density, the solution made using Part B of the present invention of pH 0.4 giving rise to a small density difference and providing a satisfactory ccloration, and the saturation of the color in the maximum density parts was excellent.

On the other hand, in comparison to the groups of couplers of the present invention, the difference was large when the comparative couplers were used. Furthermore, there was a pronounced change in the maximum density on treatment in the potassium ferricyanide bath, the density increasing, and it is clear that the blixing solution prepared after aging Part B solution of pH 4.0 of the blixing concentrate composition had a lower oxidizing power, that the change was considerable, and that the maximum density was lower. Thus, it is clear that when a blixing concentrate Part B of pH 0.4 of the present invention is used it provides excellent color-forming properties with sensitive materials containing the cyan couplers of the present invention.

Furthermore, the maximum densities ($D_m$) for the magenta couplers and yellow couplers were measured in just the same way as described above and the results obtained were as shown in Tables 7 and 8.

TABLE 7

| Sample No. | Maximum Magenta Density Part B (B-2, pH = 0.4) Immediately after Being Processed (Invention) | Part B (B-2, pH = 0.4) After Being Treated by Ferricyanide (Comparison) | Part B (B-6, pH = 4.0) Immediately after Being Processed (Comparison) | Part B (B-6, pH = 4.0) After Being Treated by Ferricyanide (Comparison) | Remarks |
|---|---|---|---|---|---|
| 02 | 2.62 | 2.62 | 2.56 | 2.63 | Couplers of the Present Invention |
| 10 | 2.60 | 2.60 | 2.55 | 2.60 | Couplers of the Present Invention |
| 11 | 2.65 | 2.66 | 2.59 | 2.65 | Couplers of the Present Invention |
| 12 | 2.61 | 2.61 | 2.54 | 2.61 | Couplers of the Present Invention |
| 16 | 2.30 | 2.43 | 2.19 | 2.44 | Comparative Couplers |

TABLE 8

| Sample No. | Maximum Yellow Density: Part B (B-2, pH = 0.4) Immediately after Being Processed (Invention) | Part B (B-2, pH = 0.4) After Being Treated by Ferricyanide (Comparison) | Part B (B-6, pH = 4.0) Immediately after Being Processed (Comparison) | Part B (B-6, pH = 4.0) After Being Treated by Ferricyanide (Comparison) | Remarks |
|---|---|---|---|---|---|
| 02 | 2.49 | 2.49 | 2.42 | 2.48 | Couplers of the Present Invention |
| 10 | 2.47 | 2.48 | 2.39 | 2.48 | Couplers of the Present Invention |
| 11 | 2.47 | 2.47 | 2.38 | 2.47 | Couplers of the Present Invention |
| 12 | 2.41 | 2.47 | 2.26 | 2.47 | Couplers of the Present Invention |
| 16 | 2.03 | 2.45 | 1.66 | 2.46 | Comparative Couplers |

It is clearly seen from the results shown in Table 7 and Table 8 that good color-forming performance was obtained when processing was carried out using a solution made from Part B blixing concentrate composition of pH not more than 1.5 of the present invention, and it is clear in conjunction with the results shown in Table 6 that the saturation of the colored image of maximum density was excellent.

Moreover, on comparing a freshly prepared solution made using Part B of the blixing concentrate composition with a solution which had been aged for 4 weeks under conditions of 40° C. after preparation, there was no change at all in terms of photographic performance between the two cases. This shows that the blixing concentrate compositions of the present invention have excellent stability.

EXAMPLE 3

A sample was prepared by coating the layers 1 (lowermost layer) to 7 (uppermost layer) on a paper which had been laminated on both sides with Polyethylene and which had been subjected to a corona discharge treatment as indicated below.

The coating solution were prepared in the following way: 600 ml of ethyl acetate as an auxiliary solvent was added to 200 g of the yellow coupler and 93.3 g of anti-color-fading agent shown in the following Table, 10 g of High Boiling Point Solvent (p) and 5 g of High Boiling Point Solvent (q), and the mixture obtained was heated to 60° C. to form a solution, after which the solution was mixed with 3,300 ml of 5 wt % aqueous gelatin solution which contained 330 ml of a 5 wt % aqueous solution of "Alkanol B" (an alkylnaphthalenesulfonate, manufactured by the Du Pont Co.) and the resulting mixture was emulsified in a colloid mill to provide a liquid coupler dispersion. The ethyl acetate was removed from this dispersion under reduced pressure, 1,400 g of an emulsion to which the sensitizing dye used for the blue-sensitive emulsion layer and 1-methyl-2-mercapto-5-acetylamino-1,3,4-triazole had been added (containing 96.7 g as silver and 170 g of gelatin) was added, and a further 2,600 g of a 10 wt % aqueous gelatin solution was added to provide a coating solution. The coating solutions for the second to the seventh layers were prepared using the same procedure as used for the first layer coating solution.

| | |
|---|---|
| Seventh Layer: Protective Layer | |
| Gelatin | 600 mg/m$^2$ |
| Sixth Layer: UV Absorbing Layer | |
| Ultraviolet Absorber (n) | 260 mg/m$^2$ |
| Ultraviolet Absorber (o) | 70 mg/m$^2$ |
| Solvent (p) | 300 mg/m$^2$ |
| Solvent (q) | 100 mg/m$^2$ |
| Gelatin | 700 mg/m$^2$ |
| Fifth Layer: Red-Sensitive Layer | |
| Silver Chlorobromide Emulsion (1 mol % AgBr) | 210 mg/m$^2$ |
| Cyan Coupler (C-4) | 260 mg/m$^2$ |
| Cyan Coupler (C-29) | 120 mg/m$^2$ |
| Anti-Color-Fading Agent (r) | 250 mg/m$^2$ |
| Solvent (p) | 160 mg/m$^2$ |
| Solvent (q) | 100 mg/m$^2$ |
| Gelatin | 1,800 mg/m$^2$ |
| Fourth Layer: Anti-Color-Mixing Layer | |
| Anti-Color-Mixing Agent (s) | 65 mg/m$^2$ |
| Ultraviolet Absorber (n) | 450 mg/m$^2$ |
| Ultraviolet Absorber (o) | 230 mg/m$^2$ |
| Solvent (p) | 50 mg/m$^2$ |
| Solvent (q) | 50 mg/m$^2$ |
| Gelatin | 1,700 mg/m$^2$ |
| Third Layer: Green-Sensitive Layer | |
| Silver Chlorobromide Emulsion (0.5 mol % AgBr) | 305 mg/m$^2$ |
| Magenta Coupler (M-2) | 670 mg/m$^2$ |
| Anti-Color-Fading Agent (t) | 150 mg/m$^2$ |
| Anti-Color-Fading Agent (u) | 10 mg/m$^2$ |
| Solvent (p) | 200 mg/m$^2$ |
| Solvent (q) | 10 mg/m$^2$ |
| Gelatin | 1,400 mg/m$^2$ |
| Second Layer: Anti-Color-Mixing Layer | |
| Silver Bromide Emulsion (primitive emulsion, grain size: 0.05 μm) | 10 mg/m$^2$ as silver |
| Anti-Color-Mixing Agent (s) | 55 mg/m$^2$ |
| Solvent (p) | 30 mg/m$^2$ |
| Solvent (q) | 15 mg/m$^2$ |
| Gelatin | 800 mg/m$^2$ |
| First Layer: Green-Sensitive Layer | |
| Silver Chlorobromide Emulsion (1 mol % AgBr) | 290 mg/m$^2$ |
| Yellow Coupler (Y-29) | 600 mg/m$^2$ |
| Anti-Color-Fading Agent (r) | 280 mg/m$^2$ |
| Solvent (p) | 30 mg/m$^2$ |
| Solvent (q) | 15 mg/m$^2$ |
| Gelatin | 1,800 mg/m$^2$ |

Support: paper support laminated on both sides with polyethylene n: 2-(2-Hydroxy-3,5-di-tert-amylphenyl)benzotriazole o: 2-(2-Hydroxy-3,5-di-tert-butylphenyl)benzotriazole p: Di(2-ethylhexyl) phthalate q: Dibutyl phthalate r: 2,5-Di-tert-amylphenyl-3,5-di-tert-butylhydroxybenzoate s: 2,5-Di-tert-octylhydroquinone t: 1,4-Di-tert-amyl-2,5-dioctyloxybenzene u: 2,2'-Methylenebis(4-methyl-6-tert-butylphenol)

Furthermore, the compounds indicated below were used as the sensitizing dyes in each emulsion layer.

Blue-Sensitive Emulsion Layer

Anhydro-5-methoxy-5,-methyl-3,3'-disulfopropylselenacyanine hydroxide

Green-Sensitive Emulsion Layer

Anhydro-9-ethyl-5,5'-diphenyl-3,3'-disulfoethyloxacarbocyanine hydroxide

Red-Sensitive Emulsion Layer 3,3'-Diethyl-5-methoxy-9,9'-(2,2-dimethyl-1,3-propano)thiadicarbocyanine iodide Furthermore, the following compound was used as a stabilizer in each of the emulsion layers: 1-Methyl-2-mercapto-5-acetylamino-1,3,4-triazole.

Furthermore, the following compounds were used as antiirradiation dyes: 4-[3-carboxy-5-hydroxy-4-{3-[3-carboxy-5-oxo-1-(4-sulfonatophenyl)-2-pyrazolin-4-ylidene]-1-propenyl}-1-pyrazolyl]benzenesulfonate, dipotassium salt and N,N'-(4,8-Dihydroxy-9,10-dioxo-3,7-disulfonatoanthracen-1,5-diyl)bis(aminomethanesulfonate) tetrasodium salt.

Furthermore, 1,2-bis(vinylsulfonyl)ethane was used as a film hardening agent.

The color photographic material obtained in the way described above was Sample 21.

A sample was then prepared by coating, after replacing the yellow coupler in the first layer with an equimolar amount of (Y-43), replacing Coupler Solvents (p) and (q) with an equimolar amount of the solvent of which the structure is indicated below:

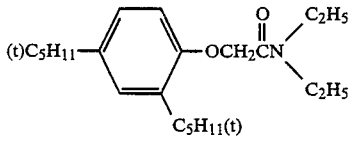

and adding the compound of which the structure is indicated below to the extent of half the total weight of the cyan coupler to the cyan coupler of the fifth layer:

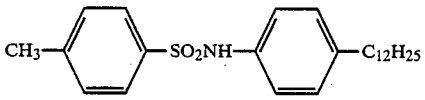

This was Sample: 22.

Moreover, a coated sample was prepared in the same way as Sample 21 except that the magenta coupler in the third layer was replaced with a 4/5ths molar equivalent amount of Coupler (M-35) and the coated weight of silver (mg/m$^2$) was reduced to one half. This was Sample 23.

The color photographic material obtained in the way described above were exposed through a wedge and the processed in the way indicated below.

| Processing Step | Temperature (°C.) | Time (sec) |
|---|---|---|
| Color Development | 35 | 45 |
| Bleach-Fixing | 35 | 45 |
| Stabilization (1) | 35 | 30 |

-continued

| Processing Step | Temperature (°C.) | Time (sec) |
|---|---|---|
| Stabilization (2) | 35 | 30 |
| Stabilization (3) | 35 | 30 |
| Drying | 70 | 60 |

The processing solution used were as follows:

| Color Developing Solution: | |
|---|---|
| Diethylhydroxylamine | 4.5 g |
| Hydroxyethyliminodiacetic Acid | 3.0 g |
| Magnesium Chloride | 0.8 g |
| Sodium Sulfite | 0.2 g |
| Triethanolamine | 10 g |
| N-Ethyl-N-(β-methanesulfonamidoethyl)-3-methyl-4-aminoaniline Sulfate | 5.5 g |
| Brightening Agent | 2.0 g |
| Sodium Chloride | 1.4 g |
| Potassium Carbonate | 30 g |
| Water to make | 1,000 ml |
| pH | 10.00 |

Bleach-Fixing Solution

B-2 and B-6 Example 1 were used.

| Stabilizinq Solution: | |
|---|---|
| 1-Hydroxyethylidene-1,1-diphosphonic Acid (60 wt %) | 1.6 ml |
| Bismuth Chloride | 0.3 g |
| Polyvinyl Pyrrolidone | 0.3 g |
| Aqueous Ammonia (26 wt %) | 2.5 ml |
| Nitrilotriacetic Acid | 1.0 g |
| 5-Chloro-2-methyl-4-isothiazoline-3-one | 0.05 g |
| 2-Octyl-4-isothiazolin-3-one | 0.05 g |
| Brightening Agent (4,4'-diaminostilbene-based) | 1.0 g |
| Water to make | 1,000 ml |
| pH (25° C.) | 7.5 |

$D_{max}$ was measured for each of the samples processed in the way described above and the results obtained on comparing the maximum densities observed using a blixing concentrate composition Part B of pH 0.4 (B-2 in Example 1) and a blixing concentrate composition Part D of pH 4 (B-6 in example 1) are shown below.

TABLE 9

| Sample | Fifth Layer (blue-sensitive layer) | | Third Layer (green-sensitive layer) | | Fifth Layer (red-sensitive layer) | |
|---|---|---|---|---|---|---|
| No. | B-2 | B-6 | B-2 | B-6 | B-2 | B-6 |
| 21 | 2.45 | 2.36 | 2.56 | 2.5O | 2.48 | 2.25 |
| 22 | 2.53 | 2.45 | 2.55 | 2.5O | 2.48 | 2.29 |
| 23 | 2.44 | 2.34 | 2.32 | 2.50 | 2.49 | 2.25 |

It is clearly seen from these results that on processing using a blixing concentrate composition Part B of pH 0.4 of the present invention the maximum densities of the yellow, magenta and cyan layers were all high and the samples exhibited good color formation. Furthermore, on observing the colored images closely it was clear that in respect of the saturation of the color in the high density region, in particular, the colored images obtained by processing with the use of a blixing concentrate composition Part B of pH 0.4 of the present invention, were more vivid.

EXAMPLE 4

The multilayer color photographic material Sample 01 prepared in Example 1, Samples 02 to 15 prepared in Example 2 and Samples 21 to 23 prepared in Example 3 were exposed through a wedge and then processed using the processing operations outlined below using a paper processing machine.

| Processing Step | Temperature (° C.) | Time (sec) |
|---|---|---|
| Color Development | 35 | 45 |
| Bleach-Fixing | 30–35 | 45 |
| Rinse (1) | 30–35 | 20 |
| Rinse (2) | 30–35 | 20 |
| Rinse (3) | 30–35 | 20 |
| Rinse (4) | 30–35 | 30 |
| Drying | 70–80 | 60 |
| (Rinse: A four tank countercurrent system from rinse (4) to rinse (1).) | | |

The composition of each of the processing solutions was as indicated below.

| | |
|---|---|
| Color Developing Solution: | |
| Water | 800 ml |
| Ethylenediamine-N,N,N',N'-tetraethylene-phosphonic Acid | 1.5 g |
| Triethanolamine | 8.0 g |
| Sodium Chloride | 1.4 g |
| Potassium Carbonate | 25.0 g |
| N-Ethyl-N-(β-methanesulfonamidoethyl)-3-methyl-4-aminoaniline Sulfate · Hydrate | 5.0 g |
| N,N-Bis(carboxymethyl)hydrazine | 7.0 g |
| Brightening Agent ("Unitex CK", manufactured by Ciba-Geigy) | 2.0 g |
| Water to make | 1,000 ml |
| pH (25° C.) | 10.10 |
| Bleach Fixing Solution: | |
| Part A: | |
| Ammonium Thiosulfate (700 g/liter) | 10 ml |
| EDTA · 2Na · $2H_2O$ | 3.4 g |
| Sodium Sulfite | 18.0 g |
| Water to make | 200 ml |
| Part B: | |
| EDTA · Fe(III) · $NH_4$ (500 g/liter) | 110 g |
| Ammonium Bromide | 40 g |
| Nitric Acid (67 wt %) to adjust to pH to 0.4 or 4.0 | |
| Water to make | 200 ml |
| Part A | 200 ml |
| Part B | 200 ml |
| Water to make | 1,000 ml |
| Adjusted to pH 5.5 with glacial acetic acid (Part B had been stored at 40° C. for a period of 4 weeks.) | |

Rinsing Solution

Ion exchanged water (calcium content and magnesium content each is less than 3 ppm.)

The maximum densities of these samples after processing in the way described above were the same as those observed on processing in a blixing solution of pH 5.5 obtained using a blixing concentrate composition Part B of pH 0.4 of the present invention as disclosed in the examples described earlier. However, the maximum densities observed on processing in a blixing solution of pH 5.5 obtained using Part B of pH 4.0 were lower than those in the former case, and the saturation of the colored image parts in the high density region was lower.

From these facts, it is clear that excellent processing can be achieved using processing solutions prepared using a blixing concentrate composition Part B of the present invention even when one part of the processing formula has been modified.

Hence, solutions in which there is no crystallization of the added components during storage (especially low temperature storage) and which have excellent aging stability can be provided by reducing the pH of the part of the concentrate composition which contains bleaching agent and acid as the principal components to 1.5 or below, this part being one of two parts which constitute a bleach-fixing concentrate composition for silver halide color photographic materials. Solutions which have excellent storage stability such that there is no deterioration of the added ingredients during storage (especially high temperature storage) can be provided as concentrates. It is possible to reduce transportation costs and packaging material costs, to facilitate handling and to provide a greater level of convenience. It is also possible by processing silver halide color photographic materials in which colored image-forming couplers of the present invention are used using these concentrates to achieve stable and rapid desilvering because there is no deterioration of the solution. There is a further advantage in that the picture quality after processing is excellent.

While the invention has been described in detail and with reference to specific embodiments thereof, it will be apparent to one skilled in the art that various changes and modifications can be made therein without departing from the spirit and scope thereof.

What is claimed is:

1. A two-part bleach-fixing solution composition for a silver halide color photographic material comprising a first concentrate composition containing a reducing compound comprising a silver halide solvent and a preservative as main components; and a second concentrate composition having a pH of 1.5 or less, containing an oxidizing compound comprising a bleaching agent and an acid as main components.

2. The two-part bleach-fixing solution composition as claimed in claim 1, wherein the concentration factor of each of said first concentrate composition and said second concentrate composition is from 3 to 20.

3. The two-part bleach-fixing solution composition as claimed in claim 1, wherein said reducing compound comprises a silver halide solvent, a preservative and a chelating agent.

4. The two-part bleach-fixing solution composition as claimed in claim 1, wherein said oxidizing compound comprises a ferric aminopolycarboxylic acid salt, a halide, a chelating agent and an acid.

5. The two-part bleach-fixing solution composition as claimed in claim 1, wherein said silver halide solvent is present in said first concentrate composition in an amount of from 5 to 10 mol/liter, and is selected from a thiosulfate, a thiocyanate, a thioether, a thiourea, a thioglycolic acid and iodide.

6. The two-part bleach-fixing solution composition as claimed in claim 1, wherein said preservative is present in said first concentrate composition in an amount of from 1 to 6 mol/liter and is selected from a sulfite, a bisulfite, a metabisulfite, an ascorbic acid, a carbonylbisulfite adduct and a sulfinic acid compound.

7. The two-part bleach-fixing solution composition as claimed in claim 1, wherein said chelating agent in said first and second concentrate compositions is an aminopolycarboxylic acid, an aminopolycarboxylic acid alkali metal salt or an aminopolycarboxylic acid ammonium salt, and said chelating agent is present in an amount of from $0.4\times10^{-2}$ to $2.7\times10^{-2}$ mol/liter of each of said first and second concentrate compositions.

8. The two-part bleach-fixing solution composition as claimed in claim 1, wherein said bleaching agent is a ferric aminopolycarboxylic acid complex salt, and is present in said second concentrate composition in an amount of from 0.2 to 2.8 mol/liter.

9. The two-part bleach-fixing solution composition as claimed in claim 1, wherein said first concentrate composition has a pH of from 5 to 9.

10. The two-part bleach-fixing solution composition as claimed in claim 1, wherein said first concentrate composition has a pH of from 6 to 8.

11. The two-part bleach-fixing solution composition as claimed in claim 1, wherein said second concentrate composition has a pH of from 0 to 1.5.

12. The two-part bleach-fixing solution composition as claimed in claim 1, wherein said second concentrate composition has a pH of from 0.1 to 0.5.

13. A method for processing a silver halide color photographic material comprising the steps of:

(a) developing an exposed silver halide color photographic material comprising a support having thereon at least one red-sensitive silver halide emulsion layer containing at least one coupler represented by formula (I) or (II); at least one green-sensitive silver halide emulsion layer containing at least one coupler represented by formula (III) or (IV); and at least one blue-sensitive silver halide emulsion layer containing a coupler represented by formula (V):

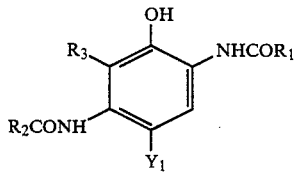

(I)

-continued

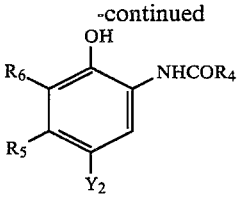

(II)

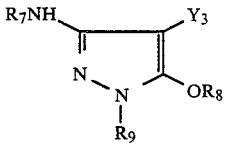

(III)

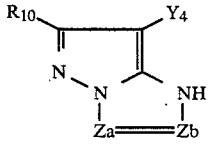

(IV)

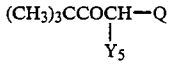

(V)

wherein $R_1$, $R_2$ and $R_4$ each represents an aliphatic group, an aromatic group, a heterocyclic group, an aromatic amino group or a heterocyclic amino group; $R_5$ represents an aliphatic group; $R_3$ and $R_6$ each represents hydrogen, a halogen atom, an aliphatic group, an aliphatic oxy group or an acylamino group; $R_7$ and $R_9$ each represents a substituted or unsubstituted phenyl group; $R_8$ represents hydrogen, an aliphatic acyl group, an aromatic acyl group, an aliphatic sulfonyl group or an aromatic sulfonyl group; $R_{10}$ represents hydrogen or a substituent; Q represents a substituted or unsubstituted N-phenylcarbamoyl group; Za and Zb each represents unsubstituted methine, substituted methine or =N—; $Y_1$, $Y_2$ and $Y_4$ each represents a halogen atom or a coupling releasable group; $Y_3$ represents hydrogen or a coupling releasable group; and $Y_5$ represents a coupling releasable group; and (b) bleach-fixing said developed silver halide color photographic material using a bleach-fixing solution prepared by diluting and combining a first concentrate composition containing a reducing compound comprising a silver halide solvent and a preservative as main components; and a second concentrate composition having a pH of 1.5 or less, containing an oxidizing compound comprising a bleaching angent and an acid as main components.

14. The method as claimed in claim 13, wherein said bleach-fixing solution has a pH of from 3 to 8.

* * * * *